US010392796B2

(12) United States Patent
Xykis et al.

(10) Patent No.: US 10,392,796 B2
(45) **Date of Patent: *Aug. 27, 2019**

(54) THREE DIMENSIONAL STRUCTURAL FRAMES AND ENCLOSURES

(71) Applicant: Power Solutions International, Inc., Wood Dale, IL (US)

(72) Inventors: Constantine Xykis, Hartland, WI (US); James Travis Baker, Oconomowoc, WI (US); Alex N. Chmidt, Walworth, WI (US); Chad Chris Goddeyne, Rockton, IL (US); Jon Michael Pomasl, Hortonville, WI (US); Kristopfer Lee Weiner, Delavan, WI (US); Brian Clement Athmer, Addison, IL (US)

(73) Assignee: Power Solutions International, Inc., Wood Dale, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/871,940

(22) Filed: Jan. 15, 2018

(65) Prior Publication Data

US 2018/0135294 A1 May 17, 2018

Related U.S. Application Data

(63) Continuation of application No. 14/818,046, filed on Aug. 4, 2015, now Pat. No. 9,879,414.
(Continued)

(51) Int. Cl.
*E04B 1/34* (2006.01)
*E04B 1/343* (2006.01)
(Continued)

(52) U.S. Cl.
CPC ..... *E04B 1/34384* (2013.01); *E04B 1/348* (2013.01); *E04B 1/34336* (2013.01);
(Continued)

(58) Field of Classification Search
CPC ..... E04C 3/04; E04C 3/08; E04C 3/06; E04C 2003/0443; E04C 2003/0404;
(Continued)

(56) References Cited

U.S. PATENT DOCUMENTS 1,457,303 A * 6/1923 Higgins ..... E04C 3/07 52/842
2,222,037 A * 11/1940 Lafferty ..... E04B 1/14 52/125.6
(Continued)

FOREIGN PATENT DOCUMENTS

| | | |
|---|---|---|
| DE | 2334140 | 1/1974 |
| WO | WO 83 04064 | 11/1983 |
| WO | WO 97 29255 | 8/1997 |

*Primary Examiner* — Adriana Figueroa
(74) *Attorney, Agent, or Firm* — McDonnell Boehnen Hulbert & Berghoff LLP

(57) ABSTRACT

Three dimensional structural frames and enclosures and related methods are disclosed herein. In an example embodiment, an enclosure includes a plurality of three dimensional structural frames and opposing wall portions interconnected by the plurality of three dimensional structural frames, where the wall portions include a plurality of uniform wall sections, where the wall sections include a wall panel portion, a top wall portion, and sidewall portions, where the sidewall portions of the plurality of wall sections are joined to form the wall portions, and where the plurality of three dimensional structural frames are attached to the top wall portions of the wall sections.

20 Claims, 18 Drawing Sheets

Related U.S. Application Data

(60) Provisional application No. 62/160,556, filed on May 12, 2015.

(51) Int. Cl.

| | |
|---|---|
| ***E04C 3/08*** | (2006.01) |
| ***E04C 3/06*** | (2006.01) |
| ***E04C 3/11*** | (2006.01) |
| ***E04B 1/348*** | (2006.01) |
| ***E04H 1/12*** | (2006.01) |
| *E04C 3/04* | (2006.01) |

(52) U.S. Cl.
CPC ..... *E04C 3/06* (2013.01); *E04C 3/08* (2013.01); *E04C 3/11* (2013.01); *E04H 1/12* (2013.01); *E04B 1/34352* (2013.01); *E04C 2003/0404* (2013.01); *E04C 2003/0413* (2013.01); *E04C 2003/0443* (2013.01); *E04C 2003/0465* (2013.01)

(58) Field of Classification Search
CPC ..... E04C 2003/0413; E04B 1/34384; E04B 1/348; E04B 1/3483
See application file for complete search history.

(56) References Cited

U.S. PATENT DOCUMENTS

| | | | | |
|---|---|---|---|---|
| 2,710,584 | A | | 6/1955 | Ross |
| 2,717,801 | A | * | 9/1955 | Neil ..... E04G 21/16 212/234 |
| 2,764,107 | A | | 9/1956 | Niswonger et al. |
| 2,858,916 | A | | 11/1958 | Josephs |
| 3,135,069 | A | | 6/1964 | Schuller et al. |
| 3,141,531 | A | | 7/1964 | Montgomery |
| 3,224,151 | A | * | 12/1965 | Nystrom ..... E04C 3/11 52/639 |
| 3,332,197 | A | * | 7/1967 | Hinkle ..... E04C 3/06 47/33 |
| 3,422,582 | A | * | 1/1969 | Van Der Lely ..... E04B 1/34815 52/79.7 |
| 3,474,578 | A | | 10/1969 | Wippermann |
| 3,498,015 | A | | 3/1970 | Green et al. |
| 3,571,993 | A | * | 3/1971 | Potter ..... E04B 1/0007 52/126.1 |
| 3,702,046 | A | * | 11/1972 | Lewis ..... E04C 2/322 52/125.2 |
| 4,114,335 | A | | 9/1978 | Carroll |
| 4,120,131 | A | | 10/1978 | Carroll |
| 4,241,551 | A | * | 12/1980 | Lajoie ..... E04B 1/34315 52/125.6 |
| 4,329,824 | A | * | 5/1982 | Lowe ..... E04C 3/07 52/634 |
| 4,435,940 | A | * | 3/1984 | Davenport ..... E04B 7/022 52/639 |
| 4,644,708 | A | * | 2/1987 | Baudot ..... E04B 1/3483 52/123.1 |
| 5,787,668 | A | | 8/1998 | Carkner et al. |
| 6,990,775 | B2 | | 1/2006 | Koester |
| 7,827,738 | B2 | | 11/2010 | Abrams et al. |
| D665,512 | S | | 8/2012 | Yoder et al. |
| D672,883 | S | * | 12/2012 | Yoder ..... D25/61 |
| D672,884 | S | * | 12/2012 | Yoder ..... D25/61 |
| D674,508 | S | | 1/2013 | Yoder et al. |
| 8,534,018 | B2 | | 9/2013 | Walker |
| 8,671,642 | B2 | | 3/2014 | Green et al. |
| 9,222,250 | B2 | | 12/2015 | Peterson et al. |
| 9,879,414 | B2 | | 1/2018 | Xykis et al. |
| 2004/0255535 | A1 | | 12/2004 | Herren |
| 2009/0173024 | A1 | | 7/2009 | Ozaki |

* cited by examiner

THREE DIMENSIONAL STRUCTURAL FRAMES AND ENCLOSURES

CROSS REFERENCE TO RELATED APPLICATIONS

The present application is a continuation of U.S. application Ser. No. 14/818,046, filed Aug. 4, 2015, entitled "Three Dimensional Structural Frames and Enclosures," which claims priority to U.S. Provisional Application No. 62/160,556, filed May 12, 2015, entitled "Three Dimensional Structural Frames and Enclosures." The entire disclosure contents of U.S. application Ser. No. 14/818,046 and U.S. Provisional Application No. 62/160,556 are herewith incorporated by reference into the present application.

BACKGROUND

Enclosures may be used to surround equipment located outside of a building in an industrial facility or equipment located inside of a building. Such enclosures may protect the equipment from a variety of environmental conditions, such as extreme temperatures, humidity, and moisture.

SUMMARY

In one aspect, a three dimensional structural member is disclosed. The three dimensional structural member includes a frame member that includes a variable cross section three dimensional structure that includes a first end and a second end; a mounting flange at the second end of the variable cross section three dimensional structure that at least partially encloses the second end, where the mounting flange includes through holes for mounting the frame member; and a transverse stiffener positioned within the variable cross section three dimensional structure that includes a rigid support structure rigidly fixed to a first flange, a web, and a second flange of the variable cross section three dimensional structure.

In another aspect, a three dimensional structural frame member is disclosed, where the variable cross section three dimensional structure is a single piece of sheet metal.

In another aspect, a three dimensional structural frame member is disclosed, where the variable cross section three dimensional structure and the mounting flange include a single piece of sheet metal.

In another aspect, a three dimensional structural frame member is disclosed, where the variable cross section three dimensional structure is an open three dimensional structure.

In another aspect, a three dimensional structural frame member is disclose, where the transverse stiffener is welded to the first flange, the web, and the second flange of the variable cross section three dimensional structure.

In another aspect, a three dimensional structural frame is disclosed. The three dimensional structural frame includes two three dimensional structural frame members connected at their first ends.

In another aspect, a three dimensional structural frame is disclosed, further including a connector for a fall protection harness between the firsts ends of the two three dimensional structural frame members.

In another aspect, a three dimensional structural frame member is disclosed. The three dimensional structural frame member includes a frame member that includes a three dimensional structure that includes a first end and a second end, where the first end has a first width, the second end has a second width, and the first and second widths are substantially equal; a mounting flange at the second end of the three dimensional structure that at least partially encloses the second end, where the mounting flange includes through holes for mounting the frame member; and a transverse stiffener positioned within the three dimensional structure that includes a rigid support structure rigidly fixed to a first flange, a web, and a second flange of the three dimensional structure.

In another aspect, a three dimensional structural frame is disclosed, where the three dimensional structure is a single piece of sheet metal.

In another aspect, a three dimensional structural frame is disclosed, where the three dimensional structure and the mounting flange include a single piece of sheet metal.

In another aspect, a three dimensional structural frame is disclosed, where the three dimensional structure is an open three dimensional structure.

In another aspect, a three dimensional structural frame is disclosed, where the transverse stiffener is welded to the first flange, the web, and the second flange of the three dimensional structure.

In another aspect, a three dimensional structural frame is disclosed. The three dimensional structural frame includes two three dimensional structural frames connected at their first ends.

In another aspect, a three dimensional structural frame is disclosed, further including a connector for a fall protection harness between the firsts ends of the two three dimensional structural frame members.

In another aspect, a three dimensional structural frame is disclosed. The three dimensional structural frame includes a frame member that includes an elongated three dimensional structure having a first side, a second side, and a center support portion, where the first side has a variable cross section from a first end to the center support portion, and where the second side has a variable cross section from a second end to the center support portion, the frame member further includes mounting flanges at the first end and the second end that at least partially enclose the first end and the second end, where the mounting flanges include through holes for mounting the frame member; a center support mounted at the center support portion; and transverse stiffeners positioned within the three dimensional structure on the first side and the second side that includes a rigid support structure rigidly fixed to a first flange, a web, and a second flange of the three dimensional structure.

In another aspect, a three dimensional structural frame is disclosed, where the frame member is a single piece of sheet metal.

In another aspect, a three dimensional structural frame is disclosed, where the center support includes a connector for a fall protection harness.

In another aspect, a three dimensional structural frame is disclosed, where the transverse stiffeners are welded to the first flange, the web, and the second flange of the three dimensional structure.

In another aspect, an enclosure is disclosed. The enclosure includes a plurality of three dimensional structural frames; and opposing wall portions interconnected by the plurality of three dimensional structural frames, where the wall portions include a plurality of uniform wall sections, where the wall sections include a wall panel portion, a top wall portion, and sidewall portions, where the sidewall portions of the plurality of wall sections are joined to form the wall portions, where the plurality of three dimensional structural frames are attached to the top wall portions of the wall sections.

In another aspect, an enclosure is disclosed, where the ends of the three dimensional structural frames overlap and are simultaneously attached to two wall sections.

In another aspect, an enclosure is disclosed, where the wall sections include a single piece of formed sheet metal.

In another aspect, an enclosure is disclosed, further including a plurality of support members, where the support members extend between the opposing wall portions.

In another aspect, an enclosure is disclosed, where the wall sections include a bottom wall portion.

In another aspect, an enclosure is disclosed, where the sidewalls of the plurality of wall sections are connected by a plurality of rivets.

In another aspect, an enclosure is disclosed, further including a gasket between the sidewall portions.

In another aspect, an enclosure is disclosed, where the gasket includes a silicone bead, polyurethane, or structural adhesive.

In another aspect, an enclosure is disclosed, further including a roof that includes a plate secured to the three dimensional structural frames.

In another aspect, an enclosure is disclosed, where the plate includes sheet metal.

In another aspect, an enclosure is disclosed, where the plate includes perforated sheet metal.

In another aspect, an enclosure is disclosed, where the roof further includes a weatherproof membrane overlaying the plate and attached to the wall panel portions of the wall sections.

In another aspect, an enclosure is disclosed, further including a first support member connected to a first group of wall sections, and a second support member connected to a second group of wall sections.

In another aspect, an enclosure disclosed, further including a strengthening member connected to the plurality of three dimensional structural frames.

In another aspect, a lift plate for engaging the ends of a plurality of three dimensional structural frames is disclosed. The lift plate includes a planar portion that includes a series of a pattern of mounting holes for receiving hardware for securing the plate to the ends of the plurality of frames; and a connecting portion for engaging a harness that provides upward force to lift the plate and the frames.

In another aspect, a lift plate is disclosed, where the connecting portion includes a reinforcement plate.

In another aspect, a lift plate is disclosed, where the connecting portion includes two reinforcement plates.

In another aspect, a liftable enclosure is disclosed. The liftable enclosure includes a plurality of the three dimensional structural frames; and at least two lift plates that include a planar portion that includes a series of a pattern of mounting holes for receiving hardware for securing the plate to the ends of the plurality of frames and a connecting portion for engaging a harness that provides an upward force to lift the plate and the frames.

In another aspect, a liftable enclosure is disclosed, further including opposing walls interconnected by the plurality of three dimensional structural frames, where the walls include a plurality of uniform wall sections, where the wall sections include a wall panel portion, a top wall portion, and sidewall portions, where the sidewall portions of the plurality of wall sections are connected to form at least a portion of a wall of the enclosure, where the plurality of three dimensional structural frames are attached to the top wall portions of the wall sections.

In another aspect, a liftable enclosure is disclosed, where the lift plates are further connected to the wall panel portions of the wall sections.

In another aspect, a method for building a structure is disclosed. The method includes fabricating opposing walls of the structure by attaching sidewall portions of a plurality of wall sections comprising a wall panel portion, a top wall portion, and sidewall portions, where the sidewall portions of the plurality of wall sections; and attaching a plurality of three dimensional structural frames to the top walls portions of the wall sections of the opposing walls.

In another aspect, a method is disclosed, where the opposing walls are fabricated while the sidewall portions are substantially horizontal.

In another aspect, a method is disclosed, where the opposing walls are uprighted by attaching a lift plate to a top end of a plurality of wall sections and lifting the top end.

In another aspect, a method for lifting an enclosure is disclosed. The method includes attaching a plurality of lift plates to the a plurality of the ends of the three dimensional structural frames and the wall panel sections of the opposing walls; attaching a harness to the plurality of lift plates; and lifting the structure with an upward force to the harness, where the lift plates include a planar portion that includes a series of a pattern of mounting holes for receiving hardware for securing the plate to the ends of the plurality of frames and the wall panel sections, and a connecting portion for attaching the harness.

BRIEF DESCRIPTION OF THE DRAWINGS

The accompanying drawings, which are included to provide a further understanding of the disclosure, are incorporated in and constitute a part of this specification, illustrate embodiments of the disclosure, and together with the detailed description serve to explain the principles of the invention. No attempt is made to show structural details of the invention in more detail than may be necessary for a fundamental understanding of the invention and various ways in which it may be practiced.

FIG. 1-1 shows aspects of the three dimensional structural frame member depicted in FIG. 1, according to an example embodiment.

FIG. 3*a*-1 shows aspects of the three dimensional structural frame depicted in FIG. 3*a*, according to an example embodiment.

FIG. 4-1 shows aspects of the three dimensional structural frame depicted in FIG. 4, according to an example embodiment.

FIG. 9-1 shows aspects of the wall section depicted in FIG. 9, according to an example embodiment.

FIG. 10*c*-1 shows aspects of the sections connected to the support member depicted in FIG. 10*c*, according to an example embodiment.

FIG. 11*b*-1 shows aspects of the three dimensional structural frames connected to a strengthening member depicted in FIG. 11*b*, according to an example embodiment.

FIG. 15*a*-1 shows aspects of the liftable enclosure shown in FIG. 15*a*, according to an example embodiment.

DESCRIPTION

I. Introduction

It may be desirable to lift enclosures in a variety of situations. As one example, when an enclosure surrounds equipment (e.g., a generator, related electrical, electronic, and mechanical components, and a fuel tank) it may be desirable to lift the enclosure to access the equipment for repair or replacement. As another example, it may be desirable to lift an enclosure during installation or fabrication of the enclosure.

In its various aspects, the disclosure is directed to three dimensional structural frames and enclosures and related methods. In an example embodiment, an enclosure may include three dimensional structural frames and opposing walls interconnected by the three dimensional structural frames, and lift plates may be connected to the three dimensional structural frames. The lift plates may be used to lift the enclosure upward. With this arrangement, the enclosure may be lifted without partially disassembling the enclosure.

Beneficially, embodiments described herein may reduce labor, equipment, and/or time needed to lift enclosures. In addition, embodiments described herein may reduce damage to the enclosure after or while the enclosure is lifted, such as excessive deformation of portions of the enclosure, plastic deformation of portions of the enclosure, and/or buckling of portions of the enclosure. Accordingly, embodiments described herein may help to reduce costs of lifting enclosures.

II. Example Apparatus

A. Three Dimensional Structural Frame Members

Figure 1:
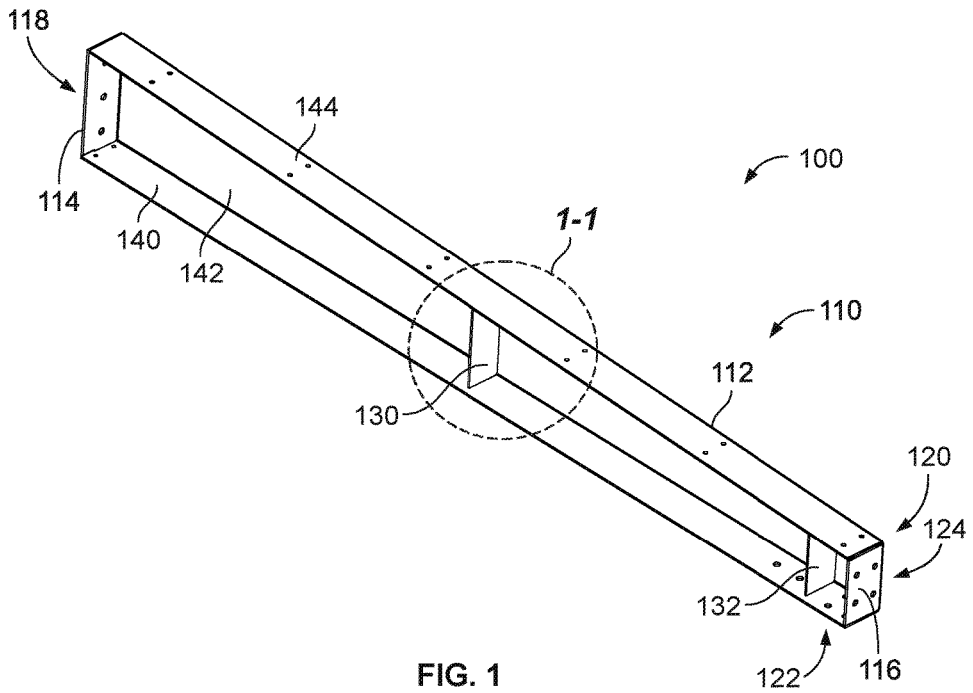
FIG. 1 shows a three dimensional structural frame member, according to an example embodiment.
Figure 1:
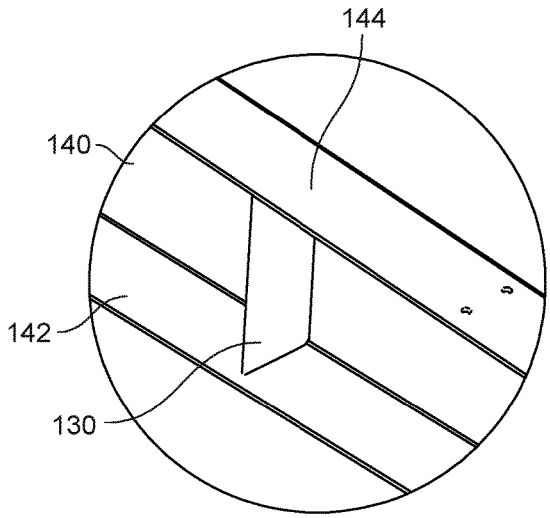

FIG. 1 shows a three dimensional structural frame member 100, according to an example embodiment. The three dimensional structural frame member 100 includes a frame member 110, a mounting flange 120, and a transverse stiffener 130. Moreover, the frame member 110 includes a variable cross section three dimensional structure 112 that includes a first end 114, a second end 116, a first (bottom) flange 140 that may define a first interior wall, a web 142 that may define a second interior wall, and a second (top) flange 144 that may define a third interior wall. The first end 114 is wider than the second end 116. With this arrangement, the variable cross section three dimensional structure 112 may comprise an open three dimensional structure comprising the first flange 140, the web 142, and the second flange 144.

The frame member 110 may comprise a variety of materials. For instance, in some embodiments, the frame member 110 may comprise steel. And in some such embodiments, the frame member 110 may comprise sheet metal of variable thickness and post processing treatments. Moreover, in some embodiments, the variable cross section three dimensional structure 112 may comprise a single piece of sheet metal. Further, in some embodiments, the variable cross section three dimensional structure 112 and mounting flange 120 may comprise a single piece of sheet metal. The variable cross section three dimensional structure 112 and mounting flange 120 may comprise the same or similar material as the frame member 110.

As shown in FIG. 1, the mounting flange 120 may be located at the second end 116 of the variable cross section three dimensional structure 120 and at least partially enclose the second end 116. The mounting flange 120 may include through holes 122 for mounting the frame member 110. In the illustrated example, the mounting flange 120 may further include second through holes 124, and the first end 114 may further include third through holes 118.

Further, as shown in FIG. 1, the transverse stiffener 130 may be positioned within the variable cross section three dimensional structure 112 and comprises a rigid support structure rigidly fixed to the first flange 140, the web 142, and the second flange 144 of the variable cross section three dimensional structure 112. In some embodiments, the transverse stiffener 130 may be welded to the first flange 140, the web 142, and the second flange 144 of the variable cross section three dimensional structure 112 as shown in FIG. 1-1. And in some such embodiments, the transverse stiffener 130 may be fillet welded to each of the first flange 140, the web 142, and the second flange 144.

The first flange 140, the web 142, and the second flange 144 may take various different forms in various different embodiments. For instance, in some embodiments, the first flange 140, the web 142, and the second flange 144 may have the same thickness. However, in other embodiments, at least two of the first flange 140, the web 142, and the second flange 144 may have different thicknesses. Moreover, in some embodiments, each of the first flange 140, the web 142, and the second flange 144 may have different thicknesses.

The first flange 140, the web 142, and the second flange 144 may have other parameters that are the same or different as well. For instance, any XYZ dimension of the first flange 140 may be the same as or different than the corresponding XYZ dimension of the web 142 and/or the second flange 144, such as width, depth, and height. Further, the moment of inertia of the first flange 140 may be the same as or different than the moment of inertia of the web 142 and/or the second flange 144.

Moreover, in some embodiments, the first flange 140, the web 142, and/or the second flange 144 may have varying thicknesses, varying XYZ dimensions, and/or varying moments of inertia.

The transverse stiffener 130 may comprise a variety of materials in variable thicknesses. For instance, in some embodiments, the transverse stiffener 130 may comprise the same or similar material as the frame member 110. However, in other embodiments, the transverse stiffener 130 may comprise a different material than the frame member 110.

Further still, as shown in FIG. 1, the three dimensional structural frame member 100 may further include a second transverse stiffener 132 positioned within the variable cross section three dimensional structure 112 and comprise a rigid support structure rigidly fixed to the first flange 140, the web 142, and the second flange 144 of the variable cross section three dimensional structure 112.

The second transverse stiffener 132 may comprise any of the materials that the transverse stiffener 130 comprises. In some embodiments, the second transverse stiffener 132 may comprise the same or similar material as the first transverse stiffener 130 and/or the frame member 110. However, in other embodiments, the second transverse stiffener 132 may comprise a different material than the transverse stiffener 130 and/or the frame member 110. The second transverse stiffener 132 may be welded to the first flange 140, the web 142, and the second flange 144 in the same or similar way as the transverse stiffener 130 is welded to the first flange 140, the web 142, and the second flange 144. The transverse stiffener 130 and/or the second transverse stiffener 132 may strengthen the three dimensional structural frame member 100, for example, by improving resistance of the three dimensional structural frame member 100 to deformation, bending, rupturing, breaking, and other modes of failure.

The location of the transverse stiffener 130 in the variable cross section three dimensional structure 112 with respect to the first end 114 and the second end 116 may be selected based on predetermined loading of the three dimensional structural frame member 100 (e.g., bending moments and/or torsional loading). Similarly, the location of the second transverse stiffener 132 in the variable cross section three dimensional structure 112 with respect to the first end 114 and second end 116 and/or the transverse stiffener 130 may be selected based on predetermined loading of the three dimensional structural frame member 100. Other parameters of the three dimensional structural frame member 100 may be selected based on predetermined loading of the three dimensional structural frame member 100 as well, such as the material or thickness of the frame member 110, width of the first end 116, and width of the second end 118.

Figure 2:
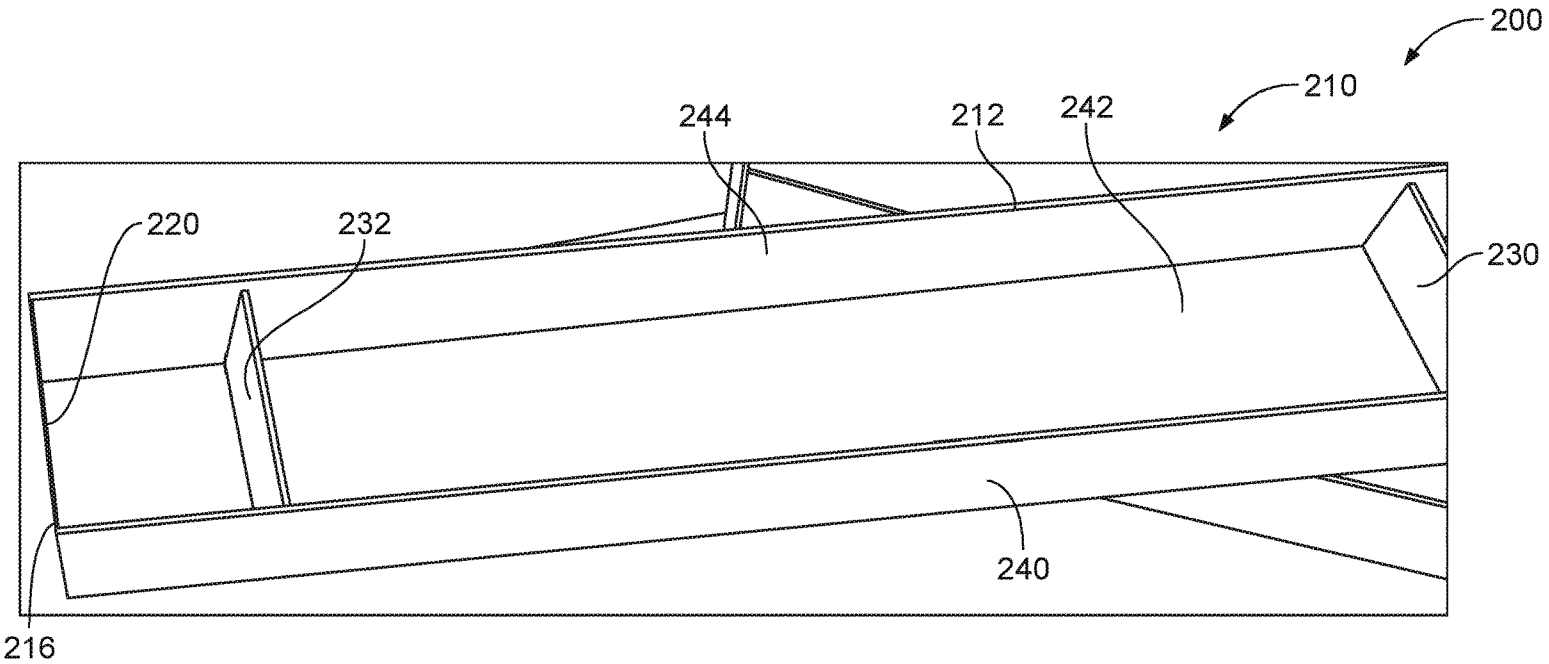
FIG. 2 shows aspects of a three dimensional structural frame member, according to an example embodiment.

FIG. 2 shows aspects of a three dimensional structural frame member 200, according to an example embodiment. The three dimensional structural frame member 200 is similar to three dimensional structural frame member 100, except that the three dimensional structural frame member 200 includes a three dimensional structure 212 that does not have a variable cross section. Instead, the three dimensional structure 212 includes two ends that have substantially equal widths. For instance, a first end (not shown in FIG. 2) has a first width, a second end 216 has a second width, and the first width and the second width are substantially equal. With this arrangement, the three dimensional structure 212 may have a constant cross section. The term "substantially equal," as used in this disclosure, means exactly equal or one or more deviations from exactly equal that do not significantly impact lifting enclosures as described herein.

As shown in FIG. 2, the three dimensional structural frame member 200 includes a frame member 210 that has the second end 216, a mounting flange 220 at the second end 216 that at least partially encloses the second end 216, and a transverse stiffener 230 positioned within the three dimensional structure 212 comprising a rigid support structure rigidly fixed to a first (bottom) flange 240 that may define a first interior wall, a web 242 that may define a second interior wall, and a second (top) flange 244 that may define a third interior wall of the three dimensional structure 212. In addition, as shown in FIG. 2, the three dimensional structural frame member 200 may further include a second transverse stiffener 232 positioned within the three dimensional structure 212 comprising a rigid support structure rigidly fixed to the first flange 240, the web 242, and the second flange 244.

The three dimensional structural frame member 200 may also include through holes, second through holes, and third through holes similar to through holes 122, second through holes 124, and third through holes 118 in the three dimensional structural frame member 100.

Components of the three dimensional structural frame member 200 of FIG. 2 may have the same or similar arrangement and function in a similar manner as similarly numbered components of the three dimensional structural frame member 100 of FIG. 1 unless otherwise noted.

For instance, in some embodiments, the three dimensional structure 212 may comprise a single piece of sheet metal. Moreover, in some embodiments, the three dimensional structure 212 and mounting flange 220 may comprise a single piece of sheet metal. Further, in some embodiments, the three dimensional structure 212 may comprise an open three dimensional structure comprising the first flange 240, the web 242, and the second flange 244. Further still, in some embodiments, the transverse stiffener 230 may be welded to the first flange 240, the web 242, and the second flange 244 of the three dimensional structure 212. The transverse stiffener 230 may be welded to the first flange 240, the web 242, and the second flange 244 of the three dimensional structure 212 in the same or similar way as the transverse stiffener 130 is welded to the first flange 140, the web 142, and the second flange 144 of the three dimensional structure 112. In addition, the second transverse stiffener 232 may be welded to the first flange 240, the web 242, and the second flange 244 of the three dimensional structure 212 in the same or similar way as the transverse stiffener 230 is welded to the first flange 240, the web 242, and the second flange 244 of the three dimensional structure 212.

B. Three Dimensional Structural Frames

Figure 3A:
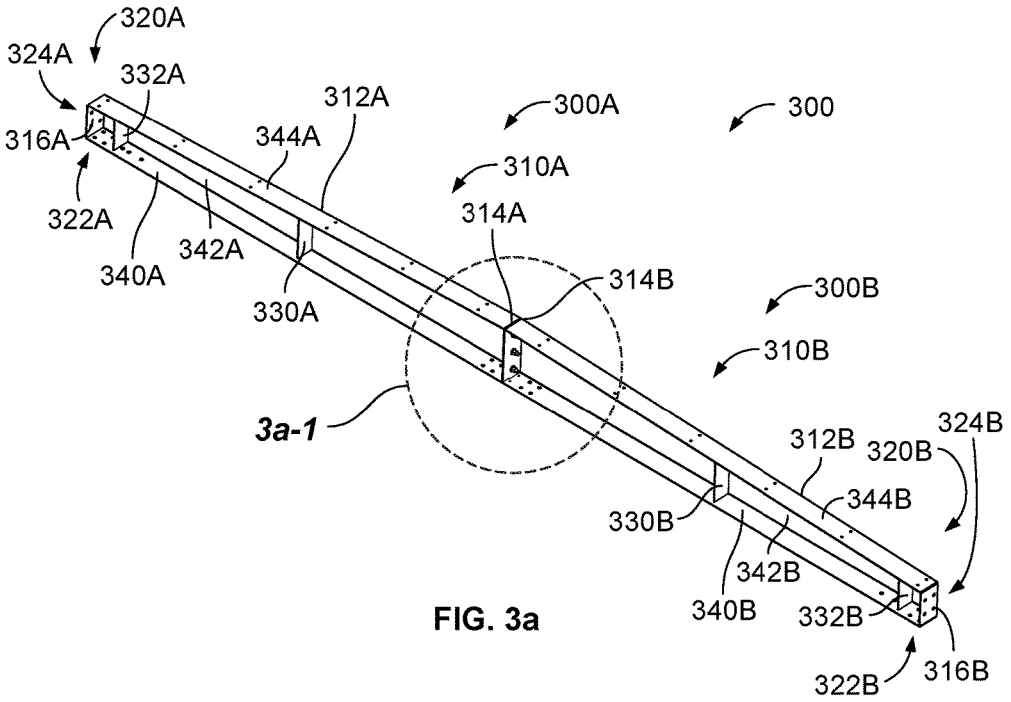
FIG. 3*a* shows a three dimensional structural frame, according to an example embodiment.
Figures 1, 3A:
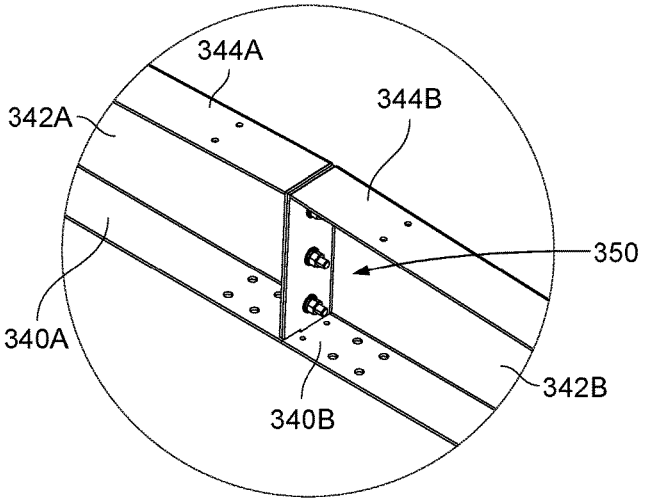

FIG. 3*a* shows a three dimensional structural frame 300, according to an example embodiment. Three dimensional structural frame 300 includes a first three dimensional structural frame member 300A and a second three dimensional structural frame member 300B joined together at their first ends 314A, 314B by a plurality of fasteners 350 as shown in FIG. 3*a*-1. In some embodiments, the plurality of fasteners 350 may comprise three fasteners. And in some such embodiments, the fasteners of the plurality of fasteners 350 may comprise screws. Moreover, in some embodiments, the plurality of fasteners 350 may be installed in through holes in first ends 314A, 314B similar to through holes 118 in three dimensional structural frame member 100.

In the illustrated example, the first three dimensional structural frame member 300A and second three dimensional structural frame member 300B may take the form of or be similar in form to the three dimensional structural frame member 100. Accordingly, components of the first three dimensional structural frame member 300A of FIG. 3*a* may have the same arrangement and function in a similar way as similarly numbered components of the three dimensional structural frame member 100 of FIG. 1, and components of the second three dimensional structural frame member 300B of FIG. 3*a* may have the same arrangement and function in a similar way as the similarly numbered components of the three dimensional structural frame member 100 of FIG. 1.

Figure 3B:
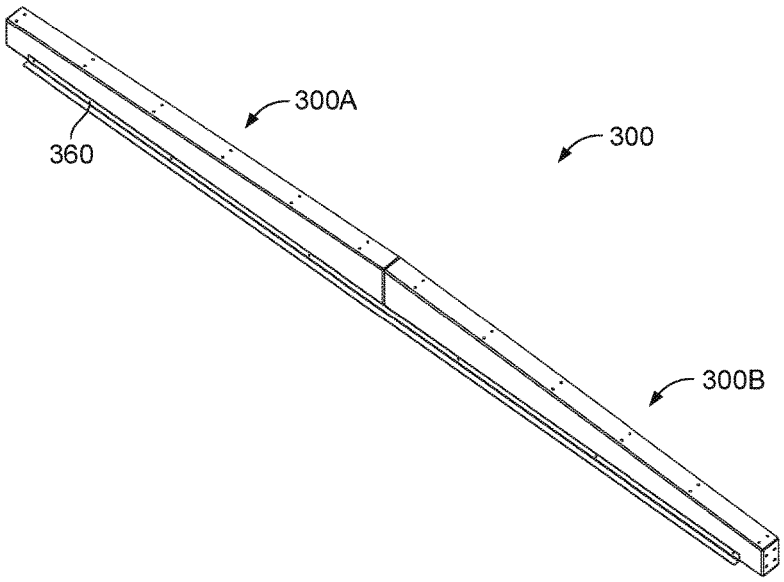
FIG. 3*b* shows a back view of the three dimensional structural frame depicted in FIG. 3*a*, according to an example embodiment.
Figure 3C:
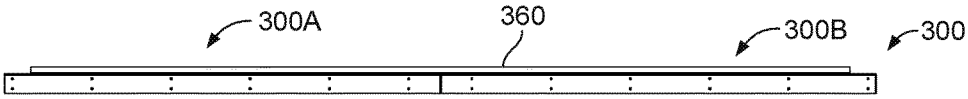
FIG. 3*c* shows a top view of the three dimensional structural frame depicted in FIG. 3*a*, according to an example embodiment.
Figure 3D:
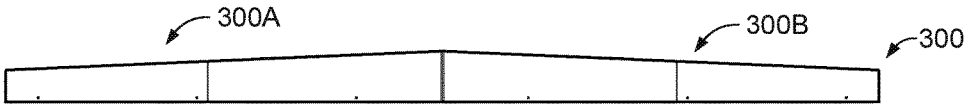
FIG. 3*d* shows a front view of the three dimensional structural frame depicted in FIG. 3*a*, according to an example embodiment.

FIG. 3*b* shows a back view of the three dimensional structural frame 300. Further, FIG. 3*c* shows a top view of the three dimensional structural frame 300, and FIG. 3*d* shows a front view of the three dimensional structural frame 300. As shown in FIGS. 3*b* and 3*c*, the three dimensional structural frame 300 may further include a support beam 360 connected to the three dimensional structure 312A of the first three dimensional structural frame member 300A and the three dimensional structure 312B of the second three dimensional structural frame member 300B. The support beam 360 may comprise the same or similar material as the frame member 110.

Figure 4:
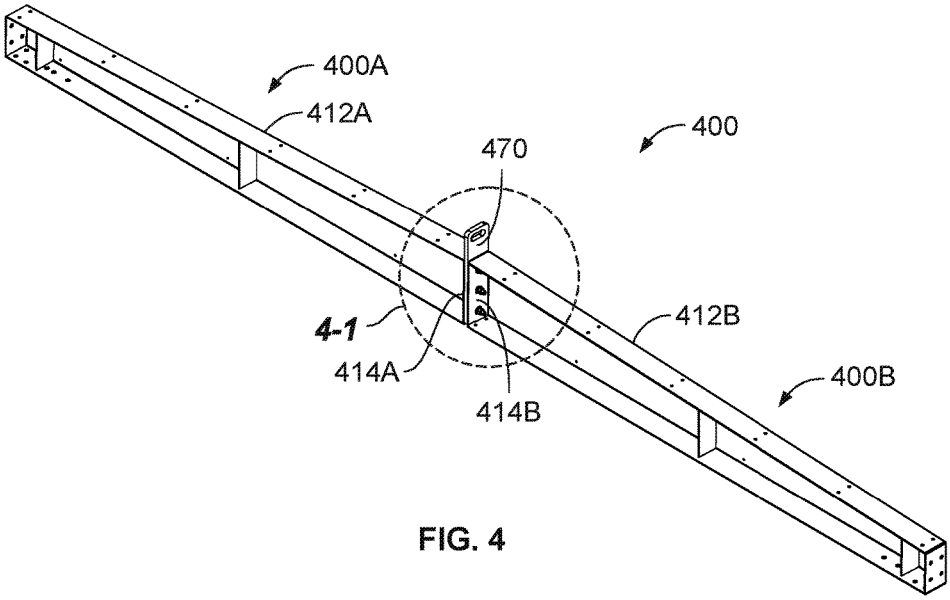
FIG. 4 shows a three dimensional structural frame, according to an example embodiment.
Figures 1, 4:
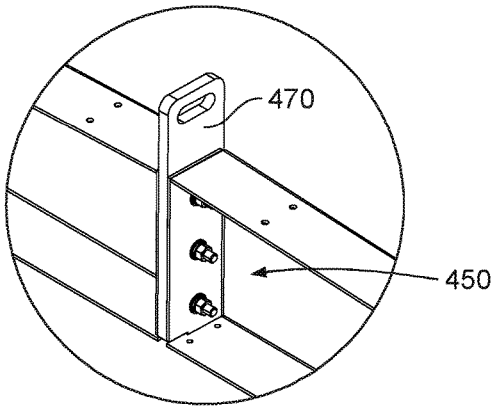

In some embodiments, a three dimensional structural frame may include a connector for a fall protection harness (which may be referred to as a fall prevention cleat). FIG. 4 shows a three dimensional structural frame 400 that includes a connector 470 for a fall protection harness, according to an example embodiment. The three dimensional structural frame 400 includes a first three dimensional structural frame member 400A and a second three dimensional structural frame member 400B joined together at their first ends 414A and 414B by a plurality of fasteners 450 as shown in FIG. 4-1.

As shown in FIGS. 4 and 4-1, the connector 470 is between the first end 414A of the first three dimensional structural frame member 400A and the first end 414B of the second three dimensional structural frame member 400B. With this arrangement, the plurality of fasteners 450 may join the connector 470 to the first three dimensional structural frame member 400A and the second three dimensional structural frame member 400B. Moreover, in some embodiments, the connector 470 may be welded to the three dimensional structure 412A of the first three dimensional structural frame member 400A and/or the three dimensional structure 412B of the second three dimensional structural frame member 400B. In some examples, the connector 470 may be fillet welded to the three dimensional structure 412A and/or the three dimensional structure 412B.

The connector 470 may comprise a variety of materials. For instance, in some embodiments, the connector 470 may comprise steel. And in some such embodiments, the connector 470 may comprise ½ inch hot rolled steel (HRS).

Further, in some embodiments, the connector 470 may strengthen the three dimensional structural frame 400 in the same or similar way as the transverse stiffener 130 and/or the second transverse stiffener 132 strengthen the three dimensional structural frame member 100.

In the illustrated example, the first three dimensional structural frame member 400A may take the form of or be similar in form to the first three dimensional structural frame member 300A, and second three dimensional structural frame member 400B may take the form of or be similar in form to the second three dimensional structural frame member 300B. Accordingly, the first three dimensional structural frame member 400A may have the same arrangement and function in a similar way as the first three dimensional structural frame member 300A, and the second three dimensional structural frame member 400B may have the same arrangement and function in a similar way as the second three dimensional structural frame member 300B.

Figure 5:
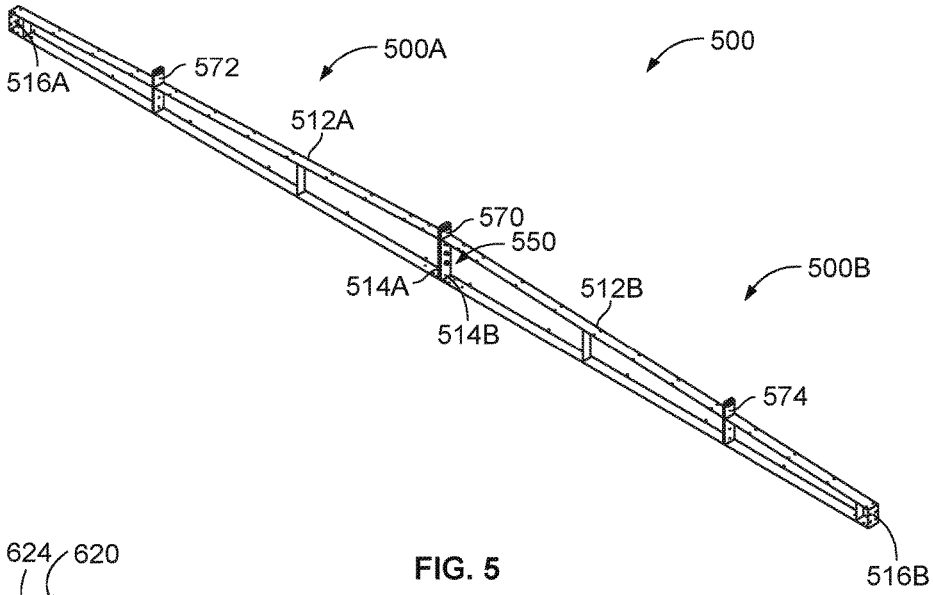
FIG. 5 shows a three dimensional structural frame, according to an example embodiment.

Moreover, in some embodiments, three dimensional structural frames may have more than one connector for a fall protection harness. FIG. 5 shows a three dimensional structural frame 500 that includes a connector 570 for a fall protection harness, a second connector 572 for the fall protection harness, and a third connector 574 for the fall protection harness. The three dimensional structural frame 500 includes a first three dimensional structural frame member 500A and a second three dimensional structural frame member 500B joined together at their first ends 514A and 514B by a plurality of fasteners 550.

The connector 570 may be between the first end 514A of the first three dimensional structural frame member 500A and the first end 515B of the second three dimensional structural frame member 500B. In addition, the connector 570 may be joined in the three dimensional structural frame 500 in the same or similar way as the connector 470 may be joined in the three dimensional structural frame 400.

In addition, the second connector 572 may be located between the first end 514A and the second end 516A of the first three dimensional structural frame member 500A. In some embodiments, the second connector 572 may be welded to the three dimensional structure 512A of the first three dimensional structural frame member 500A in the same or similar way as the connector 470 is welded to the three dimensional structure 412A and/or the three dimensional structure 412B. Moreover, the third connector 574 may be located between the first end 514B and the second end 516B of the second three dimensional structural frame member 500B. In some embodiments, the third connector 574 may be welded to the three dimensional structure 512B of the second three dimensional structural frame member 500B in the same or similar way as the connector 470 is welded to the three dimensional structure 412A and/or the three dimensional structure 412B.

Further, in some embodiments, the connector 570, the second connector 572, and the third connector 574 may strengthen the three dimensional structural frame 500 in the same or similar way as the transverse stiffener 130 and/or the second transverse stiffener 132 strengthen the three dimensional structural frame member 100.

In the illustrated example, the first three dimensional structural frame member 500A may take the form of or be similar in form to the first three dimensional structural frame member 300A, and second three dimensional structural frame member 500B may take the form of or be similar in form to the second three dimensional structural frame member 300B. Accordingly, the first three dimensional structural frame member 500A may have the same arrangement and function in a similar way as the first three dimensional structural frame member 300A, and the second three dimensional structural frame member 500B may have the same arrangement and function in a similar way as the second three dimensional structural frame member 300B.

Figure 6:
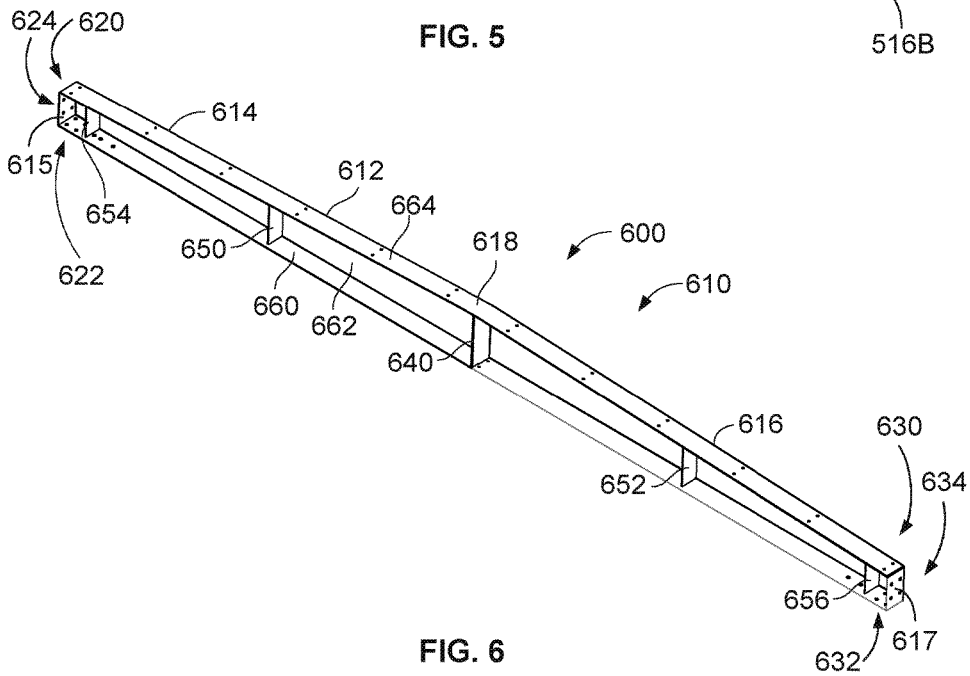
FIG. 6 shows a three dimensional structural frame, according to an example embodiment.

In some embodiments, a three dimensional structural frame may be comprised of a single member. FIG. 6 shows a three dimensional structural frame 600, according to an example embodiment. The three dimensional structural frame includes a frame member 610, mounting flanges 620 and 630, a center support 640, and transverse stiffeners 650 and 652. The frame member 610 includes an elongated three dimensional structure 612 that has a first side 614, a first end 615, a second side 616, a second end 617, and a center support portion 618. The first side 614 has a variable cross section from the first end 615 to the center support portion 618, and the second side 616 has a variable cross section from the second end 617 to the center support portion 618. The elongated three dimensional structure 612 further includes a first (bottom) flange 660 that may define a first interior wall, a web 662 that may define a second interior wall, and second (top) flange 664 that may define a third interior wall. With this arrangement, the elongated three dimensional structure 612 may comprise an open three dimensional structure with the first flange 660, the web 662, and the second flange 664 and may have a varying cross section. The frame member 610 may comprise the same or similar material as the frame member 110.

As shown in FIG. 6, the mounting flange 620 may be located at the first end 615 and at least partially enclose the first end 615, and the mounting flange 630 may be located at the second end 616 and at least partially enclose the second end 616. The mounting flange 620 may include through holes 622 for mounting the frame member 610. In the illustrated example, the mounting flange 620 may further include second through holes 624. The mounting flange 630 in turn may include through holes 632 for mounting the frame member 610. In the illustrated example, the mounting flange 630 may further include second through holes 634.

The frame member 610 may comprise the same or similar material as the frame member 110. Moreover, in some embodiments, the elongated three dimensional structure 612 may comprise a single piece of sheet metal. Further, in some embodiments, the elongated three dimensional structure 612 and mounting flanges 620, 630 may comprise a single piece of sheet metal. The elongated three dimensional structure 612 and mounting flanges 620 and 630 may comprise the same or similar material as the frame member 610.

Further, as shown in FIG. 6, the center support 640 is mounted at the center support portion 618. The center support 640 may comprise the same or similar material as the frame member 610.

Further still, as shown in FIG. 6, the transverse stiffener 650 is positioned within the elongated three dimensional structure 612 on the first side 614 of the elongated three dimensional structure 612 and comprises a rigid support structure rigidly fixed to the first flange 660, the web 662, and the second flange 664, and the transverse stiffener 652 is positioned within the elongated three dimensional structure 612 on the second side 616 of the elongated three dimensional structure 612 and comprises a rigid support structure rigidly fixed to the first flange 660, the web 662, and the second flange 664. In some embodiments, the transverse stiffeners 650, 652 may be welded to the first flange 660, the web 662, and the second flange 664 in the same or similar way as the transverse stiffener 130 is welded to the first flange 340, the web 342, and the second flange 344.

The transverse stiffeners 650, 652 may comprise a variety of materials in variable thicknesses. For instance, in some embodiments, the transverse stiffeners 650, 652 may comprise the same or similar material as the frame member 610. However, in other embodiments, the transverse stiffeners 650, 652 may comprise a different material than the elongated three dimensional structure 612.

Further still, as shown in FIG. 6, the three dimensional structural frame 600 may further include a second transverse stiffener 654 within the elongated three dimensional structure 612 on the first side 614 of the elongated three dimensional structure 612 and comprises a rigid support structure rigidly fixed to the first flange 660, the web 662, and the second flange 664, and a second transverse stiffener 656 within the elongated three dimensional structure 612 on the second side 616 of the elongated three dimensional structure 612 and comprises a rigid support structure rigidly fixed to the first flange 660, the web 662, and the second flange 664.

The second transverse stiffeners 654, 656 may comprise any of the materials that the transverse stiffeners 650, 652 comprise. In some embodiments, the second transverse stiffeners 654, 656 may comprise the same or similar material as the transverse stiffeners 650, 652 and/or the frame member 610. However, in other embodiments, the second transverse stiffeners 654, 656 may comprise a different material than the transverse stiffeners 650, 652 and/or the frame member 610. The second transverse stiffeners 650, 652 may be welded to the first flange 660, the web 662, and the second flange 664 in the same or similar way as the transverse stiffeners 650, 652 are welded to the first flange 660, the web 662, and the second flange 664. The transverse stiffeners 650, 652 and/or the second transverse stiffener 654, 656 may strengthen the three dimensional structural frame 600, for example, by improving resistance of the three dimensional structural frame 600 to deformation, bending, rupturing, breaking and other modes of failure. Similarly, the center support 640 may strengthen the three dimensional structural frame 600, for example, by improving resistance of the three dimensional structural frame 600 to deformation, bending, rupturing, breaking and other modes of failure.

The location of the transverse stiffeners 650, 652 in the elongated three dimensional structure 612 with respect to the first end 615 and the second end 617 may be selected based on predetermined loading of the three dimensional structural frame 600. Similarly, the location of the second transverse stiffeners 654, 656 in the elongated three dimensional structure 612 with respect to the first end 615 and second end 617 and/or the transverse stiffeners 650, 652 may be selected based on predetermined loading of the structural frame 600. Other parameters of the three dimensional structural frame member 600 may be selected on predetermined loading of the three dimensional structural frame member 600 as well, such as the material or thickness of the frame member 610, width of the first end 615, and width of the second end 617.

Figure 7:
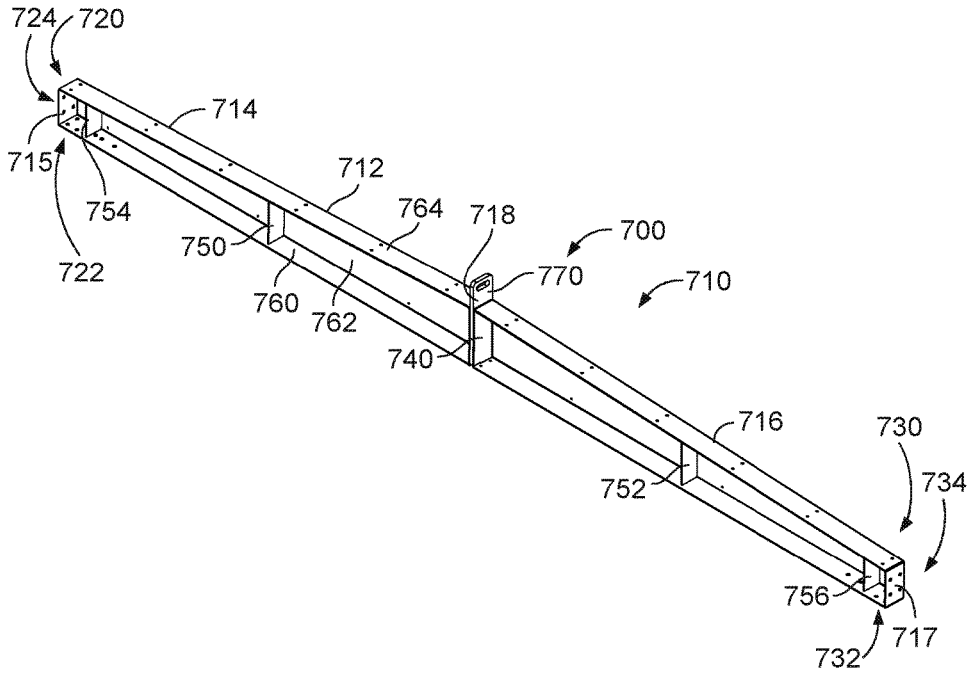
FIG. 7 shows a three dimensional structural frame, according to an example embodiment.

In some embodiments, a three dimensional structural frame that includes a single three dimensional structure may include a connector for a fall protection harness. FIG. 7 shows a three dimensional structural frame 700 that includes a connector 770 for a fall protection harness, according to an example embodiment. The three dimensional structural frame 700 includes a frame member 710, mounting flanges 720 and 730, a center support 740, transverse stiffeners 750 and 752, and second transverse stiffeners 754 and 756. Components in the three dimensional structural frame 700 of FIG. 7 may have the same or similar arrangement and function in a similar manner as similarly numbered components of the three dimensional structural frame 600 of FIG. 6 unless otherwise noted.

As shown in FIG. 7, the center support includes the connector 770. The connector 770 may take the form of or be similar in form to the connector 470. In some embodiments, the connector 770 may strengthen the three dimensional structural frame 700 in the same or similar way that the transverse stiffeners 650, 652 and/or the second transverse stiffeners 654, 656 strengthen the three dimensional structural frame 600.

In some embodiments, a three dimensional structural frame that includes a single three dimensional structure may have two or more connectors for a fall protection harness. For instance, in some embodiments, a three dimensional structural frame that includes a single three dimensional structure may have three connectors arranged in the same or similar was as connectors 570, 572, and 574 are arranged in the three dimensional structural frame 500.

In addition, in some embodiments, three dimensional structural frames may include a three dimensional structure that has a constant cross section similar to the three dimensional structure 212. For instance, in some embodiments, a structural frame may comprise two three dimensional structural frame members that are joined at their first ends, where each three dimensional structural frame member takes the form of or is similar in form to the three dimensional structural frame member 200. And in some such embodiments, the three dimensional structural frame may include one or more connectors similar to connector 470.

Moreover, in some embodiments, a three dimensional structural frame may comprise a single three dimensional structure with a constant cross section similar to the cross section of three dimensional structure 212. And in some such embodiments, the three dimensional structural frame may include one or more connectors similar to connector 470.

Further, in some embodiments, a three dimensional structural frame may comprise a first three dimensional structural frame member that takes the form of or is similar in form to the three dimensional structural frame member 100 and a second three dimensional structural frame member that takes the form of or is similar in form to the three dimensional structural frame member 200, where the first and second three dimensional structural frame members are joined at their first ends. And in some such embodiments, the three dimensional structural frame may include one or more connectors similar to connector 470.

C. Enclosures

Figure 8:
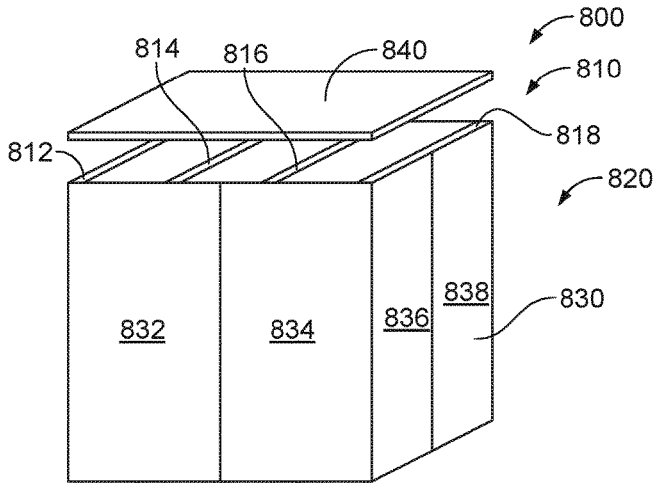
FIG. 8 shows an enclosure, according to an example embodiment.

FIG. 8 shows an enclosure 800, according to an example embodiment. The enclosure includes a plurality of three dimensional structural frames 810, opposing wall portions 820 interconnected by the plurality of three dimensional structural frames 810, and a roof 840 secured to the plurality of the three dimensional structural frames 810. In some embodiments, the enclosure 800 may have length of forty five feet.

The plurality of three dimensional structural frames 810 may take various different forms in various different embodiments. For purposes of illustration, the plurality of three dimensional structural frames 810 includes four three dimensional structural frames 812, 814, 816, 818. However, in other examples, the plurality of three dimensional structural frames 810 may include more or less than four three dimensional structural frames. The number of three dimensional structural frames in the plurality of three dimensional structural frames 810 may be selected based in part on a predetermined length and/or loading of the enclosure 800.

The three dimensional structural frames 812, 814, 816, and 818 may comprise any of the three dimensional structural frames described herein, including the three dimensional structural frames 300, 400, 500, 600, and 700 and example three dimensional structural frames that include a three dimensional structure that has a constant cross section. In some embodiments, the three dimensional structural frames 812, 814, 816, and 818 may be the same as each other. However, in other embodiments, two or more of the three dimensional structural frames 812, 814, 816, and 818 may be different. With this arrangement, the plurality of three dimensional structural frames 810 may comprise a combination of any of the three dimensional structural frames described herein.

The opposing wall portions 820 include a plurality of uniform wall sections 830. For purposes of illustration, the plurality of wall sections 830 includes four wall sections 832, 834, 836, and 838. However, in other examples, plurality of wall sections 830 may include more or less than four wall sections.

Figure 9:
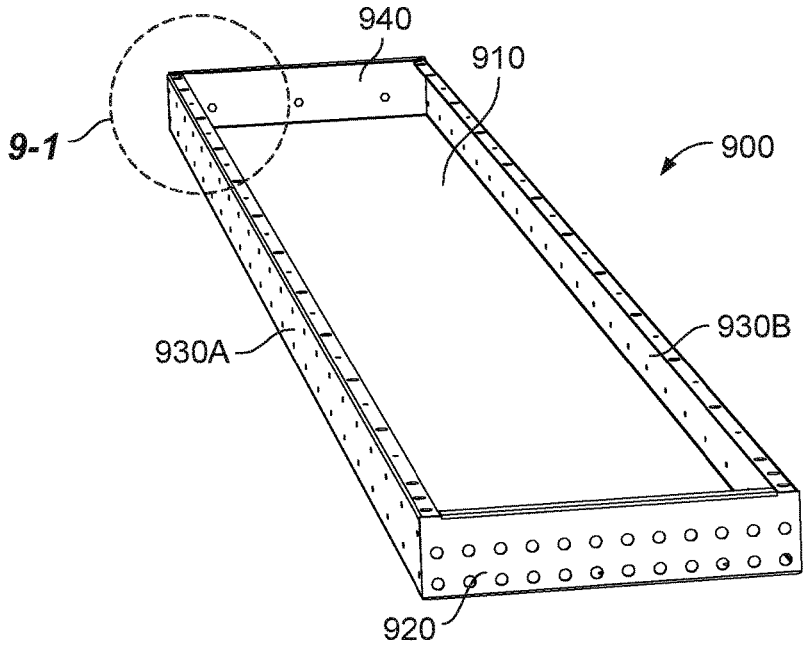
FIG. 9 shows a wall section, according to an example embodiment.
Figures 1, 9:
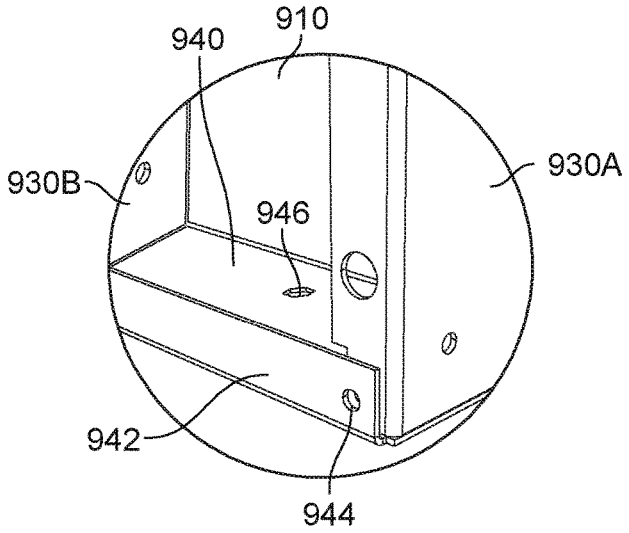

FIG. 9 shows aspects of a wall section 900, according to an example embodiment. The wall sections 832, 834, 836, and 838 may take the form of or be similar in form to the wall section 900. The wall section 900 includes a wall panel portion 910, a top wall portion 920, sidewall portions 930A, 930B, and a bottom wall portion 940. In some embodiments, the wall section 900 may comprise a single piece of formed sheet metal. Moreover, in some embodiments, the wall section 900 may comprise steel. Further, in some embodiments, the wall section 900 may be the same or similar material as the frame member 110.

The sidewall portions 930A, 930B may be joined to sidewall portions of other wall sections to form opposing wall portions, such as the opposing wall portions 820.

The bottom wall portion 940 is further shown in FIG. 9-1. For instance, the bottom wall portion 940 may include a support flange 942 that wraps around the bottom wall portion 940. With this arrangement, the support flange 942 may strengthen the bottom wall portion 940, for example, by improving resistance of the bottom wall portion 940 to deformation, bending, rupturing, breaking, and other modes of failure. The support flange 942 includes a through hole 944.

Further, as shown in FIG. 9-1, the bottom wall portion 940 includes a through hole 946. When wall section 900 is part of opposing walls of an enclosure, such as opposing walls 820 of enclosure 800, a fastener may be installed in through hole 946 to secure wall section 900 to ground or a mounting surface that the enclosure is located over, such as a skid or frame on which equipment is disposed.

Figure 10A:
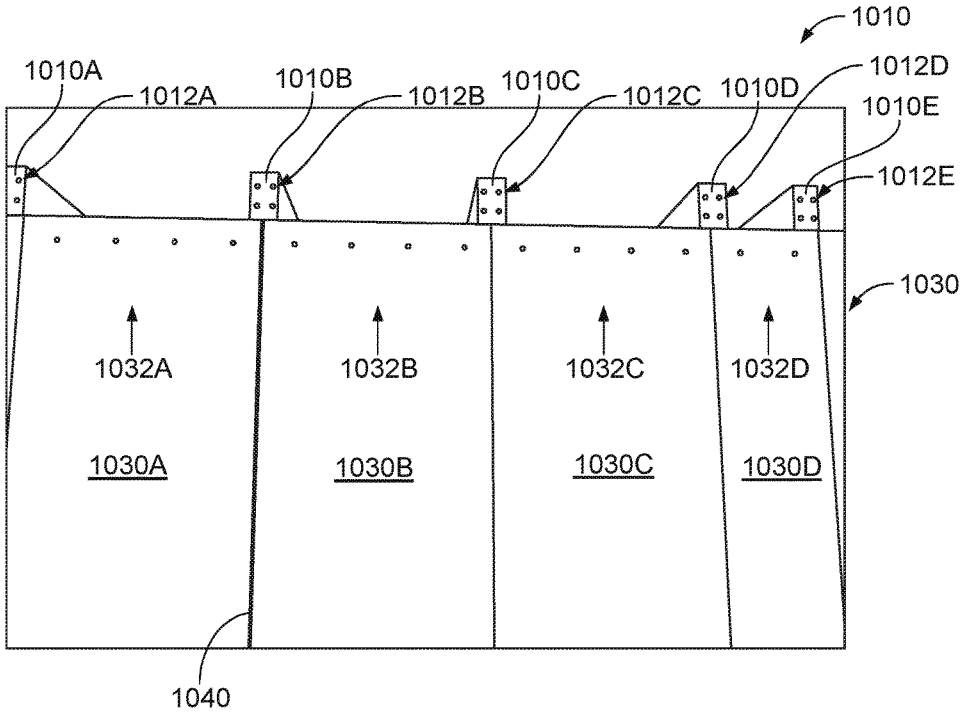
FIG. 10*a* shows three dimensional structural frames connected to wall sections, according to an example embodiment.

FIG. 10*a* shows three dimensional structural frames 1010 attached to walls sections 1030, according to an example embodiment. In particular, FIG. 10*a* shows five three dimensional structural frames 1010A-E connected to four wall sections 1030A-D. The three dimensional structural frames 1010A-E have through holes 1012A-E, respectively and the wall sections 1030A-D have through holes 1032A-D, respectively. The three dimensional structural frames 1010A-E may take the form of any of or be similar in form to any of the three dimensional structural frames described herein, and the wall sections 1030A-D may take the form of or be similar in form to the wall section 900.

As shown in FIG. 10*a*, a three dimensional structural frame is attached to a top wall portion, such as top wall portion 940, of a wall section. Moreover, as shown in FIG. 10*a*, in some embodiments, the ends of certain three dimensional structural frames overlap and are simultaneously attached to two wall sections. For instance, the end of three dimensional structural frame 1010B overlaps and is simultaneously attached to wall section 1030A and wall section 1030B, the end of three dimensional structural frame 1010C overlaps and is simultaneously attached to wall section 1030B and 1030C, and the end of three dimensional structural frame 1010D overlaps and is simultaneously attached to wall section 1030C and wall section 1030D.

Three dimensional structural frames 1010 may be attached to wall sections by hardware (e.g., fasteners) installed in through holes, such as through holes 122, 322A and 322B, and 622 and 632. Moreover, wall sections 1010 may be connected by sidewall portions, such as sidewall portions 930A and 930B.

In some embodiments, sidewall portions may be connected by a plurality of rivets (not shown). And in some such embodiments, the plurality of rivets may comprise one rivet per six inch length of the sidewall portion. Further, in some embodiments, a gasket may be located between wall sections, such as a gasket 1040 is located between wall section 1030A and wall section 1030B. As shown in FIG. 10*a*, the gasket 1040 may be located between the sidewall portion of wall section 1030A and the sidewall portion of wall section 1030B. In some embodiments, gasket 1040 may comprise a silicone bead, polyurethane, or structural adhesive (e.g., weatherproof adhesive). In addition, in some embodiments, gasket 1040 may weatherproof the plurality of rivets used to join the wall sections.

Further still, in some embodiments, the enclosure may further include a plurality of support members that extend between the opposing wall portions (not shown in FIG. 8). In some embodiments, the plurality of support members may have the same or similar material as the frame member 110. The plurality of support members may strengthen the enclosure, for example, by improving resistance of the enclosure 800 to plastic deformation and/or buckling.

Moreover, in some embodiments, a roof of an enclosure, such as the roof 840, may include a plate (or a plurality of plates) secured to the three dimensional structural frames. And in some such embodiments, the plate may comprise sheet metal and/or perforated sheet metal. Further, in some embodiments, the roof can further include a weatherproof membrane (or a plurality of membranes) overlaying the plate and attached to wall panel portions of wall sections.

Figure 10B:
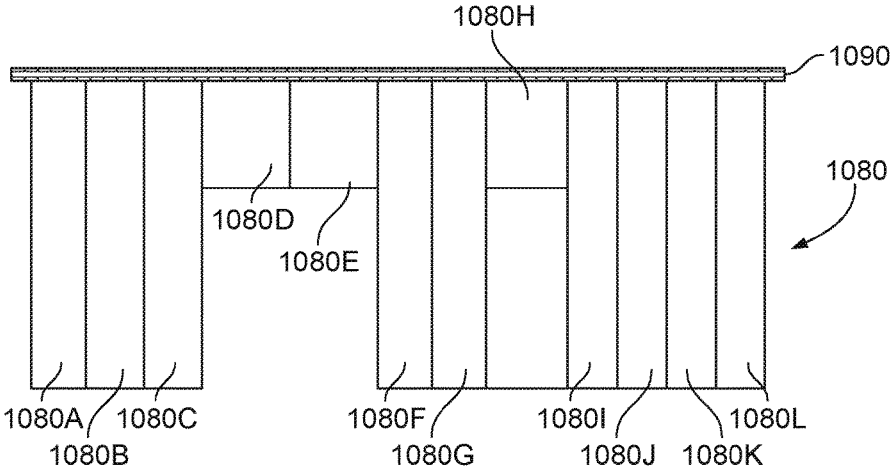
FIG. 10*b* shows wall sections connected to a support member, according to an example embodiment.

FIG. 10*b* shows wall sections 1080 connected to a support member 1090, according to an example embodiment. The enclosure 800 may further include one or more support members that may take the form of or be similar in form to the support member 1090. The support member 1090 may tie each of the wall sections 1080 together. In addition, the support member 1080 may act as a lateral brace, improve rigidity of the wall sections 1080, and/or improve resistance of the wall sections 1080 to shear loading, torsional loading, and axial loading.

As shown in FIG. 10*b*, the wall sections 1080 include twelve wall sections 1080A-L. However, in other examples, the wall sections 1080 may include more or less than twelve wall sections. The number of wall sections in the wall sections 1080 may be selected based in part on a predetermined length and/or loading of an enclosure. In the illustrated example, certain wall sections of the wall sections 1080 may have different lengths (e.g., wall sections 1080A and 1080D) and/or different widths (e.g., wall sections 1080A, 1080D, and 1080H).

Figure 10C:
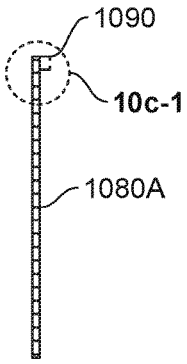
FIG. 10*c* shows a side view of the plurality of wall sections connected to the support member depicted in FIG. 10*b*, according to an example embodiment.
Figures 1, 10C:
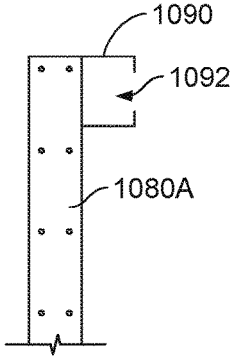

The support member 1090 may take various different forms in various different embodiments. In some embodiments, the support member 1090 may comprise steel. Moreover, in some embodiments, the support member 1090 may be connected to an end of each wall section of the wall sections 1080, such as a top end of the wall section when the wall section is oriented substantially perpendicular to ground. The term "substantially perpendicular," as used in this disclosure, refers to exactly perpendicular or one or more deviations from exactly perpendicular that do not significantly impact lifting an enclosure as described herein. FIG. 10*c* shows a side view of the wall sections 1080 connected to the support member 1090, and FIG. 10*c*-1 shows aspects of the wall sections 1080 connected to the support member 1090. As shown in FIG. 10*c*-1, in some embodiments, the support member 1090 may have a C-shaped cross section. And in some such embodiments, the support member 1090 may be oriented, such that an open portion 1092 of its cross section may face away from the wall sections 1080. Other cross sectional shapes of the support member 1090 are possible as well, including rectangular or triangular. The length of the support member 1090 may be selected based at least in part on the number of wall sections in the wall sections 1080. In addition, the thickness of the support member 1090 may be selected based at least in part on a predetermined loading of the wall sections 1080 and/or an enclosure (e.g., the thickness of the support member 1090 may increase as the predetermined loading increases).

In addition, the support member 1090 may define a wire way for electrical cabling associated with an enclosure. In some embodiments, the wire way may be partitioned to separate electrical cabling for AC circuits associated with the enclosure and electrical cabling for DC circuits associated with the enclosure. Moreover, in some embodiments, after electrical cabling is installed in the support member 1090, a closing plate (not shown) may be connected over the open portion 1092 of the support member 1090. With this arrangement, the closing plate may help to seal and protect the electrical cabling.

An enclosure may include at least two support members that take the form of the support member 1090. A first support member may be connected to a first group of wall sections and a second support member may be connected to a second group of wall sections. The first group of wall sections may be substantially parallel to the second group of wall sections. With this arrangement, the first support member may be substantially parallel to the second support member.

Figure 11A:
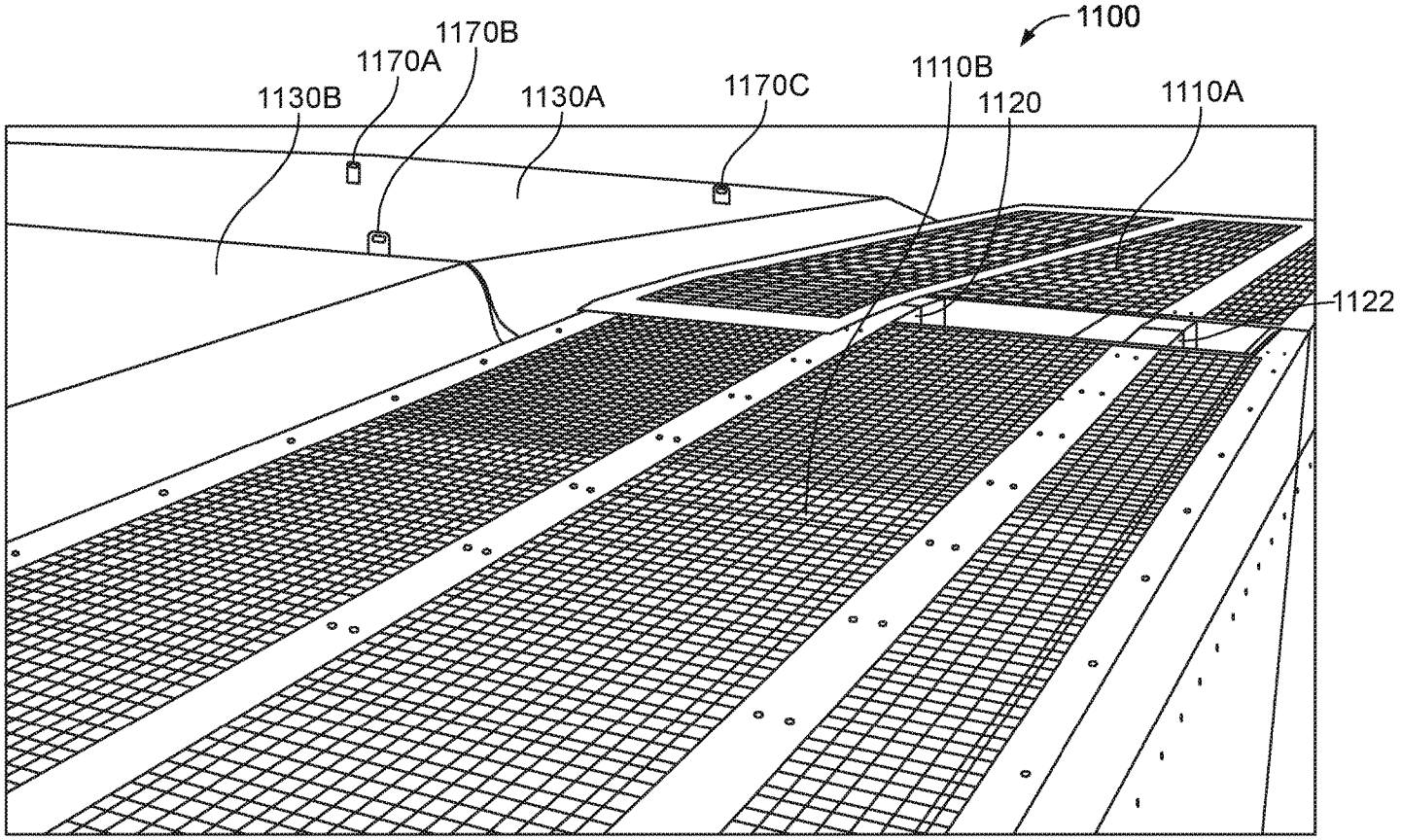
FIG. 11*a* shows aspects of a roof of an enclosure, according to an example embodiment.

FIG. 11*a* shows aspects of a roof 1100 of an enclosure, according to an example embodiment. The roof 840 may take the form of or be similar in form to the roof 1100. As shown in FIG. 11*a*, the roof 1100 includes plates attached to three dimensional structural frames. In particular, plate 1110A and plate 1110B are secured to three dimensional structural frames 1120 and 1122. Plates 1110A and plates 1110B may be secured to three dimensional structural frames 1120 and 1122 by hardware. In some embodiments, the hardware may take the form of a plurality of fasteners, such as a plurality of rivets.

The three dimensional structural frames 1120 and 1122 may take the form of or be similar in form to three dimensional structural frame 300 and/or three dimensional structural frame 600. With this arrangement, the variable cross section three dimensional structure of the three dimensional structural frames 1120 and 1122 may create a slope to the roof 1110 and help to shed water, other fluids, and debris from the roof 1100. In other examples, the three dimensional structural frames 1120 and 1122 may take the form of or be similar in form to three dimensional structural frames having a three dimensional structure with a constant cross section. With this arrangement, the three dimensional structure of the three dimensional structural frames 1120 and 1122 may help to provide structural support for the roof 1100.

In addition, in some embodiments, other components may be attached to three dimensional structural frames 1120 and 1122, including ceiling panels and insulation.

Further, as shown in FIG. 11*a*, the roof 1100 includes weatherproof membranes 1130A and 1130B overlaying plates secured to three dimensional structural frames (not shown). The membranes 1130A and 1130B may be attached to wall panel portions of the wall sections, such as wall portion 910 of the wall section 900. For instance, the membranes 1130A and 1130B may be attached to wall panel portions of the walls sections by hardware, such as a plurality of fasteners. In some such embodiments, the plurality of fasteners may be installed in through holes of the wall sections, such as through holes 1032A-1032D, and/or through holes of three dimensional structural frames, such as through holes 1012A-E. And in some such embodiments, the plurality of fasteners may comprise a plurality of rivets. The weatherproof membranes 1130A and 1130B may help to reduce moisture from passing through the roof 1100. In addition, the weatherproof membranes 1130A and 1130B may help to insulate the roof 1100.

Further still, as shown in FIG. 11*a*, the weatherproof membranes 1130A and 1130B may cover plates and three dimensional structural frames, except for connectors for fall protection harness 1170A, 1170B, and 1170C of the three dimensional structural frames. The connectors 1170A, 1170B, and 1170C may take the form of or be similar in form to the connector 470 and/or the connector 770. The connectors 1170A, 1170B, and 1170C may improve safety of the roof 1100 and/or corresponding enclosure. For instance, when maintenance is performed on the roof 1100 and/or corresponding enclosure, fall protection harness may be installed in the connectors 1170A, 1170B, and 1170C to provide fall protection.

Figure 11B:
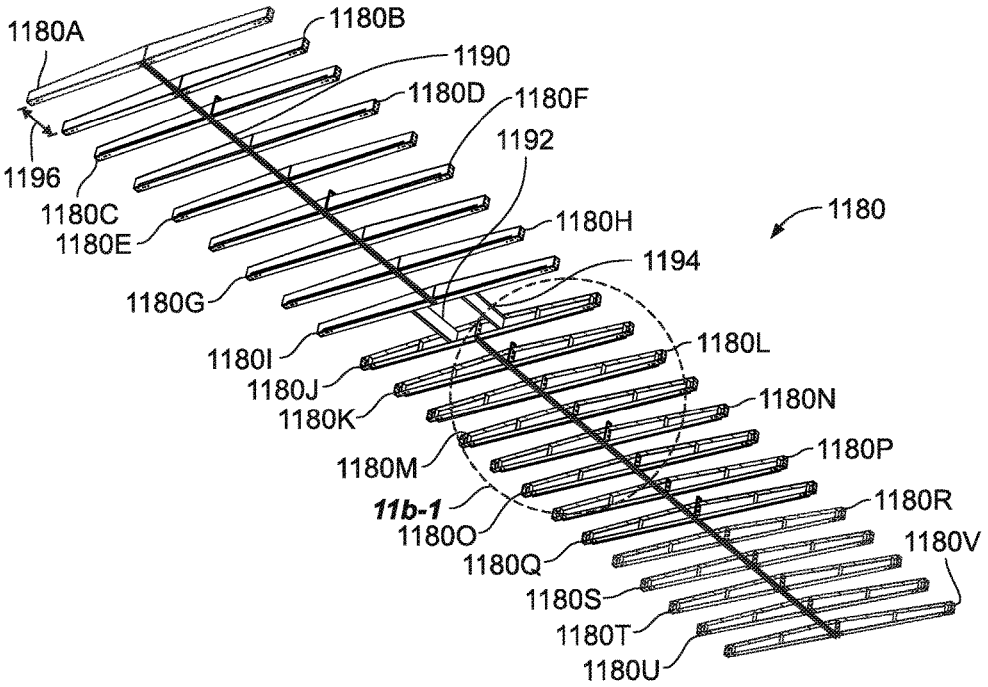
FIG. 11*b* shows three dimensional structural frames connected to a strengthening member, according to an example embodiment.
Figures 1, 11B:
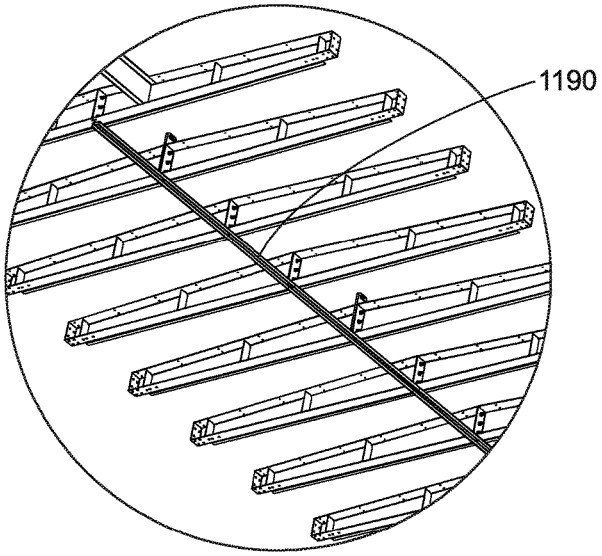

FIG. 11*b* shows three dimensional structural frames 1180 connected to a strengthening member 1190, according to an example embodiment. The enclosure 800 may further include a strengthening member that may take the form of or be similar in form to the strengthening member 1190. The strengthening member 1190 may tie each three dimensional structural frame of the three dimensional structural frames 1180 together. In addition, the strengthening member 1190 may improve resistance of the three dimensional structural frames 1180 to torsion.

As shown in FIG. 11*b*, the three dimensional structural frames 1180 include twenty-two three dimensional structural frames 1180A-V. However, in other examples, the three dimensional structural frames 1180 may include more or less than twenty-two three dimensional structural frames. The number of three dimensional structural frames in the three dimensional structural frames 1180 may be selected based at least in part on a predetermined length and/or loading of an enclosure in the same or similar way as the number of three dimensional structural frames in the plurality of three dimensional structural frames 810 is selected. Moreover, the three dimensional structural frames 1180A-V may take the form of any of the three dimensional structural frames described herein in the same or similar way as the structural frames 812, 814, 816, 818 of the plurality of structural frames 810.

The strengthening member 1190 may take various different forms in various different embodiments. In some embodiments, the strengthening member 1190 may comprise steel. Moreover, in some embodiments, the strengthening member 1190 may be connected to a center of each three dimensional structural frame of the three dimensional structural frames 1180.

FIG. 11*b*-1 shows aspects the three dimensional structural frames 1180 connected to the strengthening member 1190. As shown in FIG. 11*b*-1, in some embodiments, the strengthening member 1190 may have a U-shaped cross section. And in some such embodiments, the strengthening member 1190 may be oriented, such that an open portion (not shown) of its cross section faces toward ground. Other cross sectional shapes of the strengthening member are possible as well, including rectangular and triangular. The thickness of the strengthening member 1190 may be selected based at least in part on a predetermined loading of the three dimensional structural frames 1180 and/or an enclosure (e.g., the thickness of the strengthening member 1190 may increase as the predetermined loading increases).

As shown in FIG. 11*b*, each three dimensional structural frame member of the three dimensional structural frame members 1180 connected to the strengthening member 1190 may be spaced apart from adjacent three dimensional structural frame members a certain distance (e.g., 1180A is spaced apart from 1180B a distance 1196). In some embodiments, the distance between three dimensional structural frame members of the three dimensional structural frame members 1180 connected to the strengthening member 1190 may be substantially equal. However, in some embodiments, the distance between a first set of adjacent three dimensional structural frame members of the three dimensional structural frame members 1180 connected to the strengthening member 1190 (e.g., 1180A and 1180B) may be different than a second set of adjacent three dimensional structural frame members of the three dimensional structural frame members 1180 connected to the strengthening member 1190 (e.g., 1180M and 1180N).

The distance between adjacent three dimensional structural frame members of the plurality of structural frame members 1180 connected to the strengthening member 1190 may have various different values. For instance, in some embodiments, the distance between adjacent three dimensional structural frame members of the structural frame members 1180 connected to the strengthening member 1190 may be between 4 inches and 2 feet, such as 4 inches, 6 inches, one foot, and two feet. The distance between adjacent three dimensional structural frame members of the structural frame members 1180 connected to the strengthening member 1190 may be based at least in part on a width of the three dimensional structural frame members 1180. In some such embodiments, the width of at least one three dimensional structural frame member of the three dimensional structural frame members 1180 may be 3 inches. Moreover, in some such embodiments, when a three dimensional structural frame member comprises a support beam (e.g., support beam 360), the width of the three dimensional structural frame member may be 4 inches.

Further, as shown in FIG. 11*b*, beams 1192 and 1194 may be connected between three dimensional structural frame 11801 and three dimensional structural frame 1180J. With this arrangement, beams 1192 and 1194 may define a penetration in a roof of an enclosure. In some embodiments, an exhaust component may be installed in the penetration. The beams 1192 and 1194 may take various different forms in various different embodiments. For instance, in some embodiments, the beams 1192 and 1194 may comprise steel. In addition, in some embodiments, the beams 1192 and 1194 may comprise C-channels. Moreover, in some embodiments, the beams 1192 and 1194 may be flush with a web of the three dimensional structural frames 11801 and 1180J (e.g., web 342A). Further, in some embodiments, the beams 1192 and 1194 may each be welded to the web of the three dimensional structural frames 11801 and 1180J. The thickness of the beams 1192 and 1194 may be selected based at least in part on a predetermined loading of the three dimensional structural frames 1180 and/or an enclosure (e.g., the thickness of the beams 1192 and 1194 may increase as the predetermined loading increases).

Figure 12A:
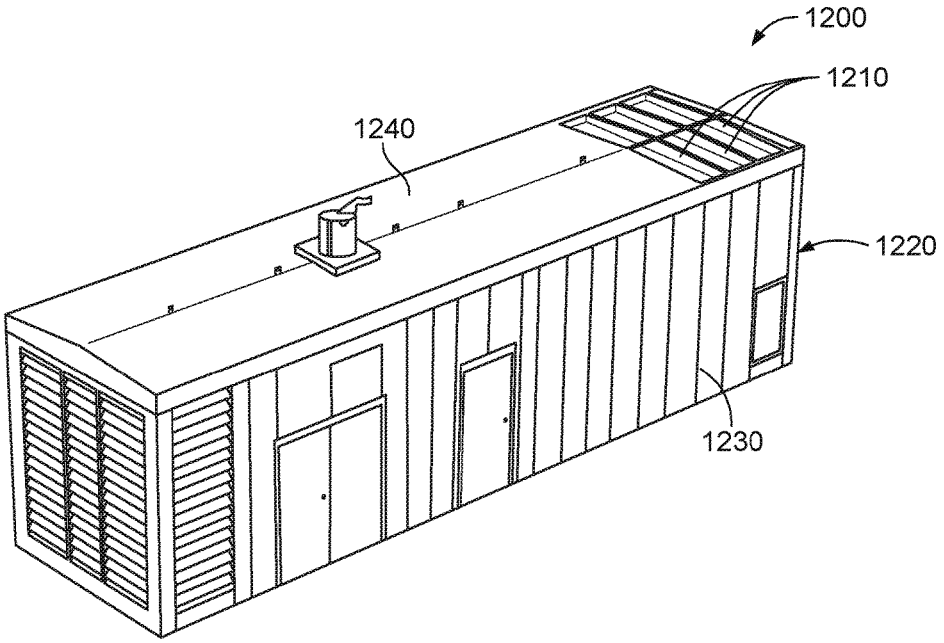
FIG. 12*a* shows an enclosure, according to an example embodiment.

FIG. 12*a* shows an enclosure 1200, according to an example embodiment. The enclosure 1200 may include a plurality of three dimensional structural frames 1210, opposing wall portions 1220 interconnected by the plurality of three dimensional structural frames 1210, and a roof 1240 secured to at least some of the three dimensional structural frames of the plurality of three dimensional structural frames 1210. The opposing wall portions 1220 may include a plurality of wall sections 1230. In some embodiments, the roof 1240 may be secured to all of the three dimensional structural frames of the plurality of three dimensional structural frames 1210. With this arrangement, the roof 1240 may cover all of the three dimensional structural frames of the plurality of three dimensional structural frames 1210.

Components of the enclosure 1200 of FIG. 12*a* may have the same arrangement and function in a similar manner as similarly numbered components of the enclosure 800 of FIG. 8. The enclosure 1200 may be used to surround equipment described herein.

In some embodiments, the enclosure 1200 may have a length of forty five feet. Moreover, in some embodiments, the enclosure 1200 may be designed to withstand loads caused by wind that has a speed of 150 miles per hour.

Figure 12B:
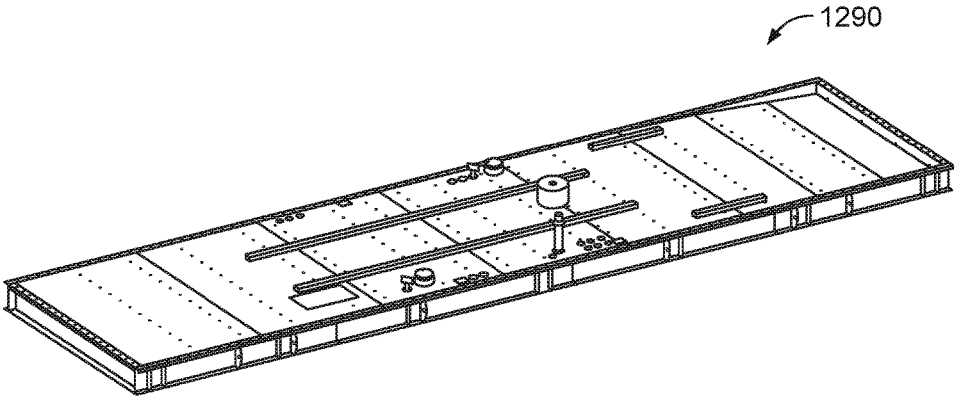
FIG. 12*b* shows a mounting surface, according to an example embodiment.

Further, in some embodiments, the enclosure 1200 may be secured to a mounting surface 1290 shown in FIG. 12*b*. Equipment may be located over the mounting surface 1290. And in some such embodiments, the plurality of wall sections 1230 may be secured to the mounting surface 1290 via through holes in bottom wall portions of the wall sections, such as through holes 946. Further, in some embodiments, the enclosure 1200 may be secured to a mounting plane.

D. Lift Plates

Figure 13:
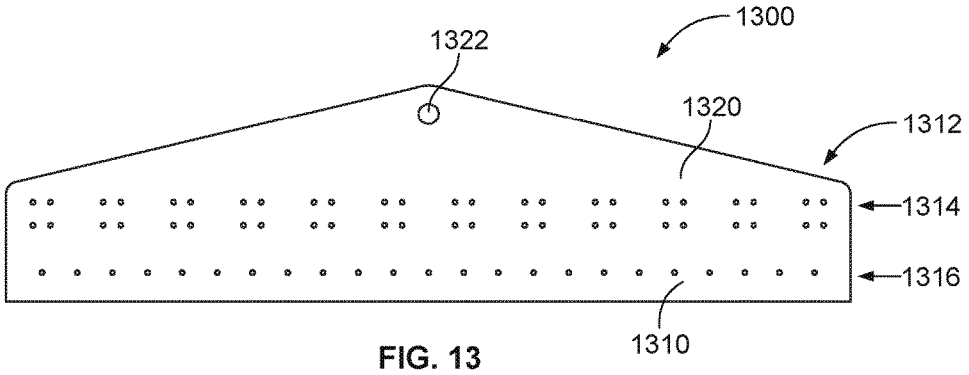
FIG. 13 shows a lift plate, according to an example embodiment.

FIG. 13 shows a lift plate 1300, according to an example embodiment. The lift plate 1300 may engage the ends of a plurality of three dimensional structural frames, such as the plurality of three dimensional structural frames 810. The lift plate 1300 may include a planar portion 1310 comprising a series of a pattern of mounting holes 1312 for receiving hardware for securing the lift plate 1300 to the ends of the plurality of three dimensional structural frames and a connecting portion 1320 for engaging a harness that provides upward force to lift the plate and frames. The series of a pattern of mounting holes 1312 may include a first series of a pattern of mounting holes 1314 and a second series of a pattern of mounting holes 1316. The connecting portion 1320 may include a hole 1322 for receiving the harness. As shown in FIG. 13, the hole 1322 may be located through the connecting portion 1320.

In some embodiments, the lift plate 1300 may be configured to be secured to two or more three dimensional structural frames, such as twelve three dimensional structural frames. For instance, hardware may engage the first series of a pattern of mounting holes 1314 and through holes of the three dimensional structural frames, such as through holes 1012B and 1012C. Moreover, in some embodiments, the lift plate 1300 may be configured to be secured to two or more wall sections, such as four wall sections. For instance, hardware may engage the second series of a pattern of mounting holes 1316 and through holes of the wall sections, such as through holes 1032A-D. In some embodiments, the hardware may include fasteners, such as bolts and rivet nuts.

The lift plate 1300 may comprise a variety of materials. For instance, in some embodiments, the lift plate 1300 may comprise steel. And in some such embodiments, the lift plate 1300 may comprise 5/16 inch hot rolled steel. Moreover, in other embodiments, the lift plate 1300 may comprise steel having other thicknesses.

Figure 14A:
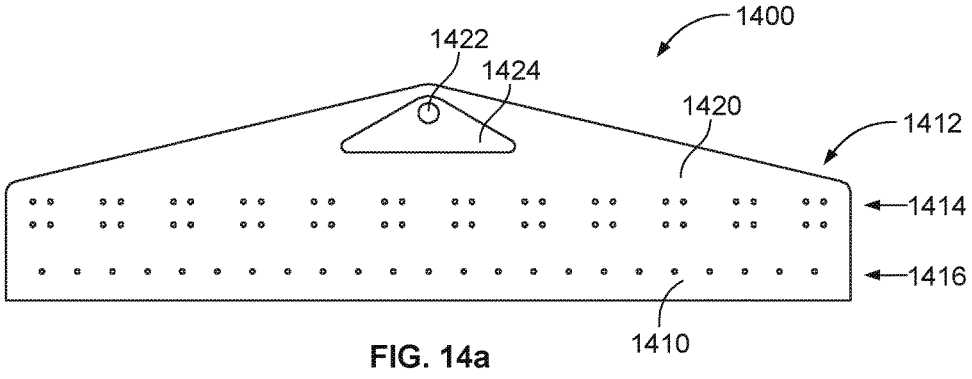
FIG. 14*a* shows a lift plate, according to an example embodiment.
Figure 14B:
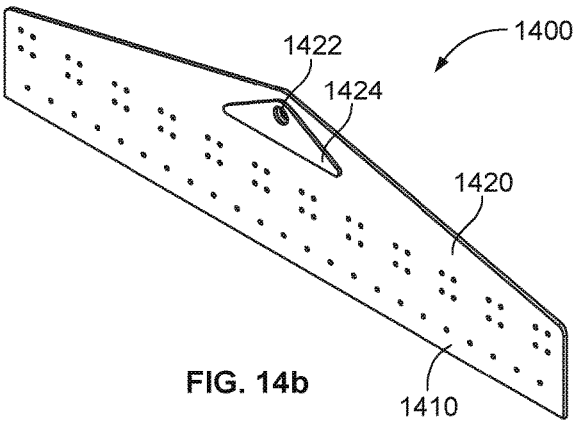
FIG. 14*b* shows a perspective view of the lift plate shown in FIG. 14*a*, according to an example embodiment.

In some embodiments, a connecting portion of a lift plate may include a reinforcement plate. FIG. 14*a* shows a lift plate 1400, according to an example embodiment. The lift plate 1400 includes a connecting portion 1420 that includes a reinforcement plate 1424. The lift plate 1400 may engage the ends of a plurality of three dimensional structural frames, such as the plurality of three dimensional structural frames 810. The lift plate 1400 may include a planar portion 1410 comprising a series of a pattern of mounting holes 1412 for receiving hardware for securing the lift plate 1400 to the ends of the plurality of three dimensional structural frames and the connecting portion 1420 for engaging a harness that provides upward force to lift the plate and frames. The series of a pattern of mounting holes 1412 may include a first series of a pattern of mounting holes 1414 and a second series of a pattern of mounting holes 1416. The connecting portion 1420 may include a hole 1422 for receiving the harness and the reinforcement plate 1424. As shown in FIG. 14*a*, the hole 1422 may be located through the connecting portion 1420 and the reinforcement plate 1424. FIG. 14*b* shows a perspective view of the lift plate 1400, according to an example embodiment. In some embodiments, the hardware may include fasteners, such as bolts and rivet nuts.

Components of lift plate 1400 of FIG. 14*a* may have the same arrangement and function in a similar manner as similarly numbered components of the lift plate 1300 of FIG. 13. In addition, the lift plate 1400 may be secured to the ends of the plurality of three dimensional structural frames and wall sections in the same or similar way as the lift plate 1300 is secured to the ends of the plurality of three dimensional structural frames and wall sections.

In some embodiments, the reinforcement plate 1424 may be welded to the connecting portion 1420. And in some such embodiments, the reinforcement plate 1424 may be fillet welded to the connecting portion 1420. Moreover, the reinforcement plate 1424 may comprise a variety of materials. For instance, in some embodiments, the reinforcement plate 1424 may comprise steel. And in some such embodiments, the reinforcement plate 1424 may comprise the same or similar material as the planar portion 1410 and the connecting portion 1420.

The reinforcement plate 1424 may strengthen the lift plate 1400, for example, by improving resistance of the lift plate 1400 to deformation, bending, rupturing, breaking, and other modes of failure.

Figure 14C:
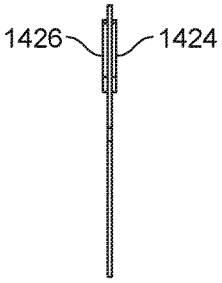
FIG. 14*c* shows a side view of the lift plate shown in FIG. 14*a*, according to an example embodiment.

Further, in some embodiments, the lift plate 1400 may have a second reinforcement plate 1426. FIG. 14*c* shows a side view of the lift plate 1400, according to an example embodiment. As shown in FIG. 14*c*, the second reinforcement plate 1426 may be located opposite the reinforcement plate 1424. The second reinforcement plate 1426 may have the same arrangement and function in a similar manner as the reinforcement plate 1424. Moreover, the second reinforcement plate 1426 may be welded to the connecting portion 1420 in the same or similar way as the reinforcement plate 1424 is welded to the connecting portion 1420.

The second reinforcement plate 1426 may strengthen the lift plate 1400 in the same or similar way as the reinforcement plate 1400 strengthens the lift plate 1400.

E. Liftable Enclosures

Figure 15A:
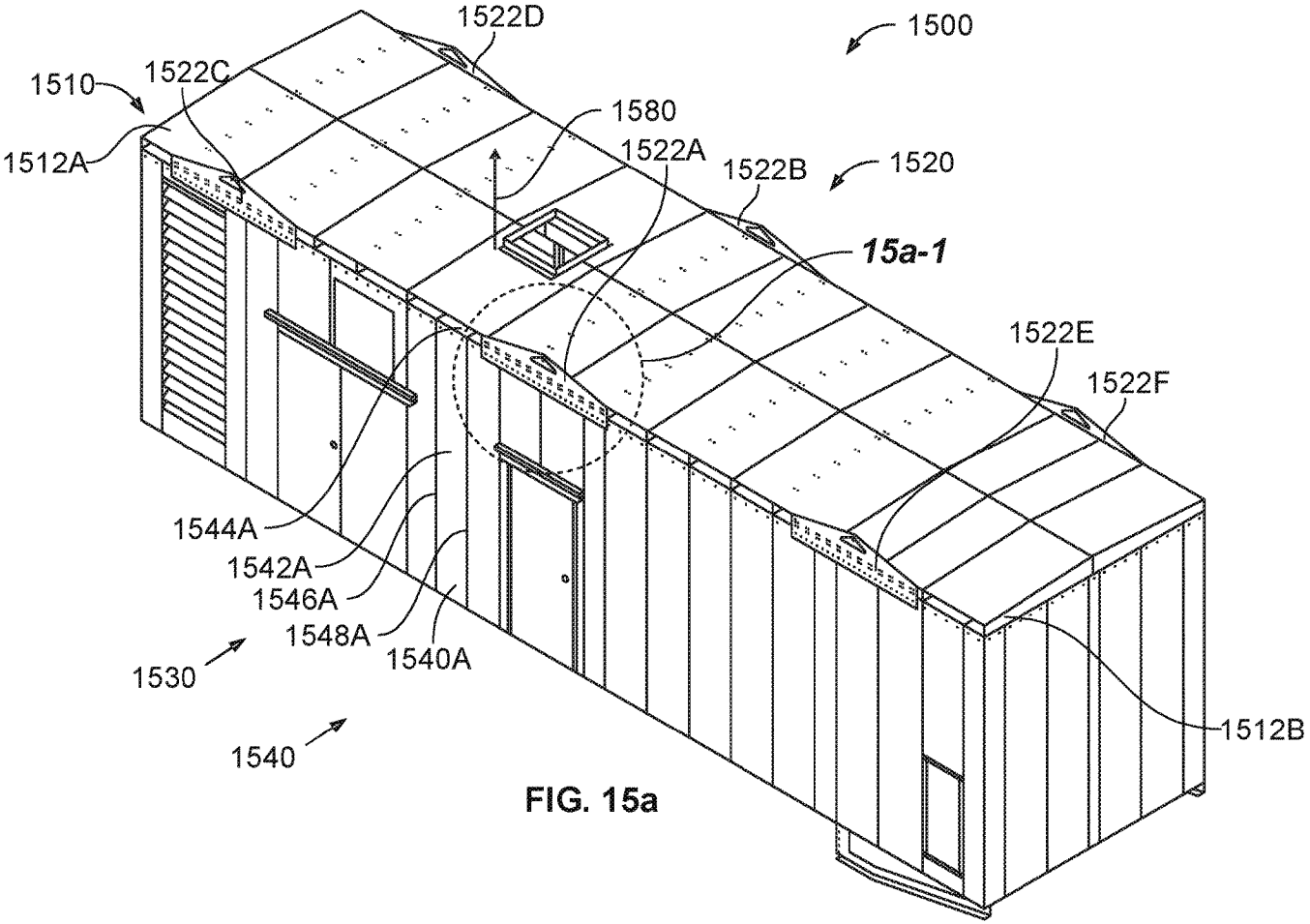
FIG. 15*a* shows a liftable enclosure, according to an example embodiment.
Figures 1, 15A:
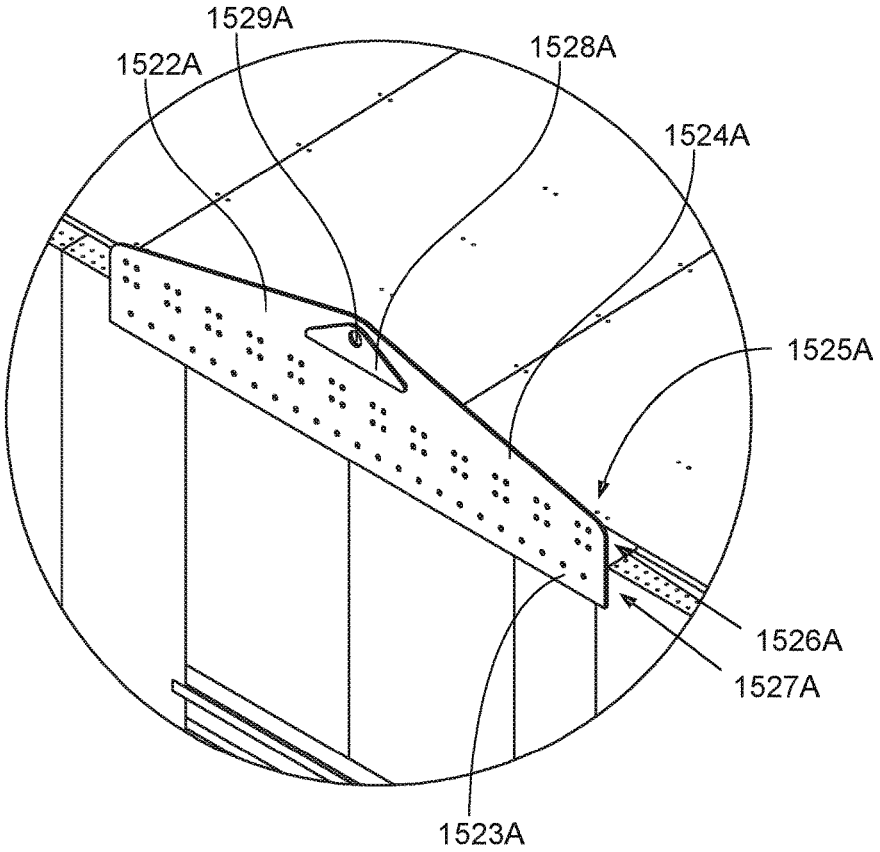

FIG. 15*a* shows a liftable enclosure 1500, according to an example embodiment. The liftable enclosure 1500 includes a plurality of the three dimensional structural frames 1510 and at least two lift plates 1520. The at least two lift plates 1520 may be used to lift the liftable enclosure 1500 with an upward force in a direction that is substantially parallel to a direction 1580. The term "substantially parallel," as used in this disclosure, means exactly parallel or one or more deviations from exactly parallel that do not significantly impact lifting an enclosure as described herein.

In the illustrated example, a first three dimensional structural frame 1512A may be located at a first end of the liftable enclosure 1500 and a second three dimensional structural frame 1512B may be located at a second end of the liftable enclosure 1500. Numerous three dimensional structural frames may be located between the first three dimensional structural frame 1512A and the second three dimensional structural frame 1512B. The three dimensional structural frames of the plurality of three dimensional structural frames 1510 may take the form of any of the three dimensional structural frames described herein.

Moreover, in the illustrated example, the at least two lift plates 1520 may include six lift plates 1522A-F. However, in other examples, the at least two lift plates 1520 may include more or less six lift plates, such as two lift plates or eight lift plates. In some embodiments, when the at least two lift plates 1520 include six lift plates, the liftable enclosure 1500 may have a length of forty five feet. Moreover, in some embodiments, when the liftable enclosure 1500 has a length greater than forty five feet, the at least two lift plates 1520 may include more than six lift plates, such as eight lift plates. Lift plates may be equally distributed on two sides of the liftable enclosure 1500. For example, as shown in FIG. 15*a*, when the at least two lift plates 1520 include six lift plates, three lift plates (1522A, 1522C, and 1522E) may be located on a first side of the liftable enclosure 1500, and three lift plates (1522B, 1522D, and 1522F) may be located on a second side of the liftable enclosure 1500.

As shown in FIG. 15*a*-1, the lift plate 1522A includes a planar portion 1523A comprising a series of a pattern of mounting holes 1525A for receiving hardware for securing the plate to the ends of the plurality of three dimensional structural frames 1510 and a connecting portion 1524A for engaging a harness that provides an upward force to lift the lift plate 1522A and the three dimensional structural frames 1510. The series of a pattern of mounting holes 1525A may include a first series of a pattern of mounting holes 1526A and a second series of a pattern of mounting holes 1527A. The connecting portion may further include a hole 1529A for receiving the harness and a reinforcement plate 1528B. The hole 1529A may be through the connecting portion 1524 and the reinforcement plate 1528B. The lift plates 1522B-F may take the form of or be similar in form to and function in a similar manner as the lift plate 1522A.

The planar portion 1523A may take the form of or be similar in form to the planar portion 1410, the connecting portion 1524A may take the form of or be similar in form to the connecting portion 1420, the series of a pattern of mounting holes 1525A may take the form of or be similar in form to the series of a pattern of mounting holes 1412, the first series of a pattern of mounting holes 1526A may take the form of or be similar in form to the first series of a pattern of mounting holes 1414, the second series of a pattern of mounting holes 1527A may take the form of or be similar in form to the second series of a pattern of mounting holes 1416, the reinforcement plate 1528A may take the form of or be similar in form the reinforcement plate 1424, and the hole 1529A may take the form of or be similar in form to the hole 1422.

In some embodiments, the lift plate 1522A may be configured to be secured to two or more three dimensional structural frames, such as twelve three dimensional structural frames. For instance, hardware may engage the first series of a pattern of mounting holes 1526A and through holes of the three dimensional structural frames, such as through holes 1012B and 1012C. In some embodiments, the hardware may include fasteners, such as bolts and rivet nuts. With this arrangement, one four-through-hole pattern of the first series of a pattern of mounting holes 1526A may correspond to through holes of a three dimensional structural frame, such as through holes 1012B and 1012C. Lift plates 1522B-E may be configured to be secured to three dimensional structural frames in the same or similar way that the lift plate 1522A is configured to be secured to three dimensional structural frames.

Further, the liftable enclosure 1500 includes opposing walls 1530 interconnected by the plurality of three dimensional structural frames 1510, wherein the walls 1530 comprise a plurality of uniform wall sections 1540. In the illustrated example, wall section 1540A includes a wall panel portion 1542A, a top wall portion 1544A, and sidewall portions 1546A and 1548A. With this arrangement, the sidewall portions of the plurality of wall sections 1540 are connected to form at least a portion of a wall of the enclosure 1500, where the plurality of three dimensional structural frames 1510 are attached to the top wall portions of the wall sections 1540. In some embodiments, the lift plates 1520 may be connected to the wall panel portions of the wall sections.

The wall panel portion 1542A may take the form of or be similar in form to the wall panel portion 910, the top wall portion 1544A may take the form of or be similar in form to the top wall portion 920, and sidewall portions 1546A and 1548A may take the form of or be similar in form to the sidewall portions 930A and 930B.

In some embodiments, the lift plate 1522A may be configured to be secured to two or more wall sections, such as four wall sections. For instance, hardware may engage the second series of a pattern of mounting holes 1527A and through holes of the wall sections, such as through holes 1032A-D. In some embodiments, the hardware may include fasteners, such as bolts and rivet nuts.

Further, in some embodiments, when the liftable enclosure 1500 includes a roof with a weatherproof membrane, such as the weatherproof membranes 1130A and 1130B, hardware may engage the series of pattern of mounting holes, through holes of the three dimensional structural frame members, and through holes of the wall sections after the weatherproof membrane is secured to the three dimensional structural frame members and walls sections. And in some such embodiments, the weatherproof membrane is secured to the three dimensional structural frame members via the through holes of the three dimensional structural frame members and via the through holes of the wall sections.

Further still, in some embodiments, using the at least two lift plates 1520 to lift the liftable enclosure 1500 may reduce damage to the enclosure after or while the enclosure is lifted. Moreover, in some embodiments, the enclosure 1500 may be designed to withstand loads caused by wind that has a speed of 150 miles per hour.

III. Example Methods

Figure 16:
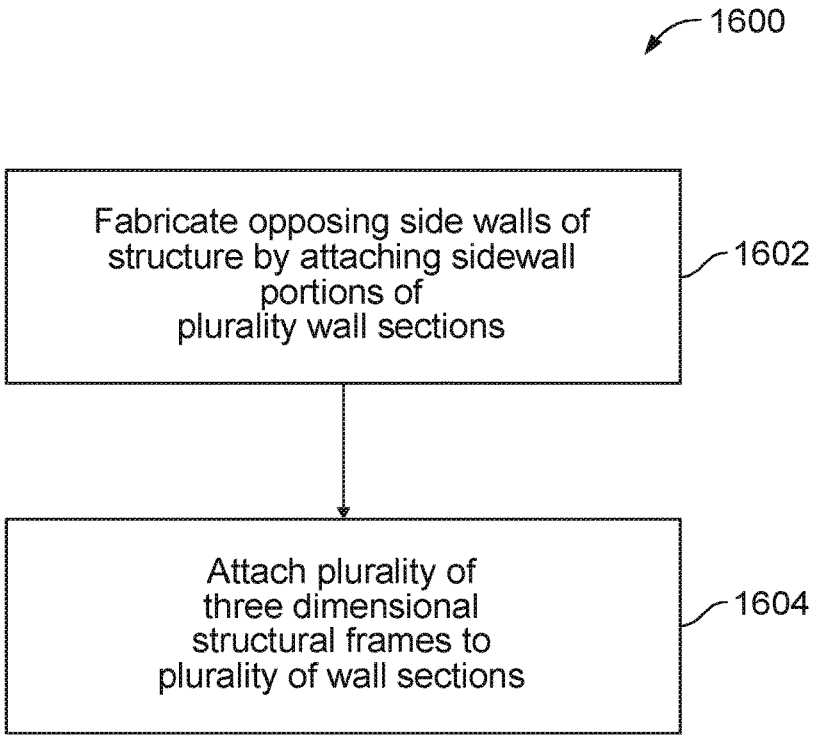
FIG. 16 shows a method for building a structure, according to an example embodiment.

FIG. 16 shows a method 1600 for building an enclosure, according to an example embodiment. Method 1600 begins at block 1602 with fabricating opposing walls of the enclosure by attaching sidewall portions of a plurality of wall sections comprising a wall panel portion, a top wall portion, and sidewall portions, wherein the sidewall portions of the plurality of wall portions are connected to form at least a portion of a wall of the enclosure. The opposing walls may take the form of or be similar in form to the opposing walls 820, opposing walls 1220, and/or the opposing walls 1530; and the wall sections may each take the form of or be similar in form to the wall section 900.

Method 1600 continues at block 1604 with attaching a plurality of three dimensional structural frames to the top wall portions of the wall sections of the opposing walls. The plurality of three dimensional structural frames may take the form of or be similar in form to the plurality of three dimensional structural frames 810, the plurality of three dimensional structural frames 1210, and/or the plurality of three dimensional structural frames 1510.

In some embodiments, the opposing walls are fabricated while the sidewall portions are substantially horizontal. The term "substantially horizontal," as used in this disclosure, means exactly horizontal or one or more deviations from exactly horizontal that do not significantly impact lifting enclosures described herein. Moreover, in some embodiments, the opposing walls are uprighted by attaching a lift plate to a top end of a plurality of wall sections and lifting the top end. The lift plate may take the form of or be similar in form to the lift plate 1300 and/or the lift plate 1400.

Figure 17:
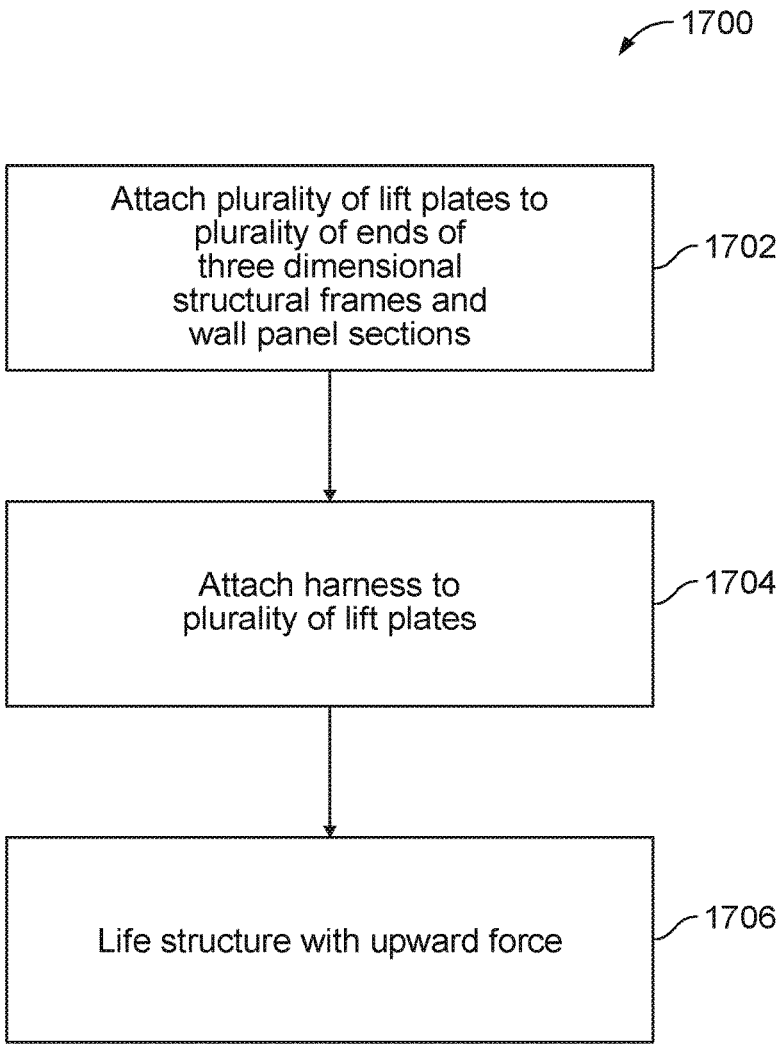
FIG. 17 shows a method for lifting an enclosure, according to an example embodiment.

FIG. 17 shows a method 1700 for lifting an enclosure, such as the enclosure 800 and/or the enclosure 1300, according to an example embodiment. Method 1700 begins at block 1702 with attaching a plurality of lift plates to a plurality of the ends of the three dimensional structural frames and wall panels sections of the opposing walls. Further, method 1700 continues at block 1704 with attaching a harness to the plurality of lift plates. And method continues at block 1706 with lifting the enclosure with an upward force to the harness.

In some embodiments, the lift plates comprise (i) a planar portion comprising a series of a pattern of mounting holes for receiving hardware for securing the plate to the ends of the plurality of frames and the wall panel sections, and (ii) a connecting portion for attaching the harness. The lift plates may take the form of or be similar in form to the lift plate 1300 and/or the lift plate 1400. Moreover, in some embodiments, the harness may be attached to the plurality of lift plates via a hole in the lift plates, such as the hole 1322 and/or the hole 1422.

IV. Conclusion

Examples given above are merely illustrative and are not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to the skilled artisan.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that, as used herein and in the appended claims, the singular forms "a," "an," and "the" include the plural reference unless the context clearly dictates otherwise. Thus, for example, a reference to "a three dimensional structural frame" is a reference to one or more three dimensional structural frames and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

Any numerical values recited herein include all values from the lower value to the upper value in increments of one unit provided that there is a separation of at least two units between any lower value and any higher value. As an example, if it is stated that the concentration of a component or value of a process variable such as, for example, size, angle size, pressure, time and the like, is, for example, from 1 to 90, specifically from 20 to 80, more specifically from 30 to 70, it is intended that values such as 15 to 85, 22 to 68, 43 to 51, 30 to 32, etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Particular methods, devices, and materials are described, although any methods and materials similar or equivalent to those described herein can be used in the practice or testing of the invention. The disclosures of all references and publications cited above are expressly incorporated by reference in their entireties to the same extent as if each were incorporated by reference individually.

What is claimed is:

1. An enclosure, comprising:

(a) a plurality of three dimensional structural frames, wherein at least one three dimensional structural frame of the plurality of three dimensional structural frames comprises:

two three dimensional structural frame members connected at their first ends, wherein each three dimensional structural frame member of the two three dimensional structural frame members comprises:

a frame member comprising a variable cross section three dimensional structure comprising the first end, a second end, a first flange comprising an inner edge and an outer edge, a web, and a second flange comprising an inner edge and an outer edge, wherein the web extends from the first end to the second end, and wherein the web extends from the inner edge of the first flange to the inner edge of the second flange so as to define a channel, a mounting flange at the second end of the variable cross section three dimensional structure that at least partially encloses the second end, wherein the mounting flange comprises through holes for mounting the frame member, and a transverse stiffener positioned within the variable cross section three dimensional structure comprising a rigid support structure rigidly fixed to the first flange, the web, and the second flange of the variable cross section three dimensional structure; and (b) opposing wall portions interconnected by the plurality of three dimensional structural frames, wherein the wall portions comprise a plurality of uniform wall sections, wherein the wall sections each comprise a wall panel portion formed from a single sheet, a top wall portion that extends substantially perpendicularly from the wall panel portion, and sidewall portions that extend substantially perpendicularly from the wall panel portion, wherein the sidewall portions of the plurality of wall sections are joined to form the wall portions, and wherein the plurality of three dimensional structural frames are attached to the top wall portions of the wall sections, and wherein the at least one three dimensional structural frame of the plurality of three dimensional structural frames is directly attached to the top wall portion of one of the wall sections.

2. The enclosure of claim 1, wherein the at least one three dimensional structural frame of the plurality of three dimensional structural frames further comprises a connector for a fall protection harness sandwiched between the first ends of the two three dimensional structural frame members, wherein the connector comprises a first surface and a second surface opposite the first surface, wherein a first portion of the first surface contacts the first end of one of the two three dimensional structural frame members, wherein a first portion of the second surface contacts the first end of the other three dimensional structural frame member, and wherein a second portion of the first surface and a second portion of the second surface each extend above each second flange of the two three dimensional structural frame members.

3. The enclosure of claim 1, wherein the wall sections each further comprise a bottom wall portion that extends from the wall panel portion.

4. The enclosure of claim 1, wherein the sidewalls of the plurality of wall sections are connected by a plurality of rivets, wherein the enclosure further comprises a gasket between at least two sidewall portions of the sidewall portions, and wherein the gasket comprises a silicone bead, polyurethane, or structural adhesive.

5. The enclosure of claim 1, further comprising: a roof comprising a plate secured to at least one three dimensional structural frame of the three dimensional structural frames and an overlaying weatherproof membrane, wherein the plate comprises sheet metal, and wherein the overlaying weatherproof membrane is attached to the wall panel portions of the wall sections.

6. A method for lifting the enclosure of claim 1, comprising:

(a) attaching a plurality of lift plates to at least some second ends of the three dimensional structural frames and at least some of the wall panel sections of the opposing walls, wherein a first lift plate of the plurality of lift plates is secured to two or more frames of the three dimensional structural frames, and wherein a second lift plate of the plurality of lift plates is secured to two or more other frames of the three dimensional structural frames, and wherein the first lift plate is secured to two or more wall panel sections of the opposing walls, and the second lift plate is secured to two or more other wall panel sections of the opposing walls;

(b) attaching a harness to the plurality of lift plates; and (c) lifting the enclosure with an upward force to the harness, wherein the first lift plate and the second lift plate each comprises (i) a planar portion comprising a series of a pattern of mounting holes for receiving hardware for securing the plate to the ends of the plurality of frames and the wall panel sections; and (ii) a connecting portion for attaching the harness.

7. The enclosure of claim 1, wherein the variable cross section three dimensional structure is formed from a second single sheet.

8. The enclosure of claim 1, wherein the wall sections are each formed from the single sheet.

9. The enclosure of claim 1, wherein two three dimensional structural frames of the plurality of three dimensional structural frames are each directly attached to the top wall portion of one of the wall sections.

10. An enclosure, comprising:

(a) a plurality of three dimensional structural frames, wherein at least one three dimensional structural frame of the plurality of three dimensional structural frames comprises:

two three dimensional structural frame members connected at their first ends, wherein each three dimensional structural frame member of the two three dimensional structural frame members comprises:

a frame member comprising a three dimensional structure comprising the first end, a second end, a first flange comprising an inner edge and an outer edge, a web, and a second flange comprising an inner edge and an outer edge, wherein the first end has a first distance between the first flange and the second flange, the second end has a second distance between the first flange and the second flange, and the first and second distances are substantially equal, wherein the web extends from the first end to the second end, and wherein the web extends from the inner edge of the first flange to the inner edge of the second flange so as to define a channel, a mounting flange at the second end of the three dimensional structure that at least partially encloses the second end, wherein the mounting flange comprises through holes for mounting the frame member, and a transverse stiffener positioned within the three dimensional structure comprising a rigid support structure rigidly fixed to the first flange, the web, and the second flange of the three dimensional structure; and (b) opposing wall portions interconnected by the plurality of three dimensional structural frames, wherein the wall portions comprise a plurality of uniform wall sections, wherein the wall sections each comprise a wall panel portion formed from a single sheet, a top wall portion that extends substantially perpendicularly from the wall panel portion, and sidewall portions that extend substantially perpendicularly from the wall panel portion, wherein the sidewall portions of the plurality of wall sections are joined to form the wall portions, wherein the plurality of three dimensional structural frames are attached to the top wall portions of the wall sections, and wherein the at least one three dimensional structural frame of the plurality of three dimensional structural frames is directly attached to the top wall portion of one of the wall sections.

11. The enclosure of claim 10, wherein the at least one three dimensional structural frame of the plurality of three dimensional structural frames further comprises a connector for a fall protection harness sandwiched between the first ends of the two three dimensional structural frame members, wherein the connector comprises a first surface and a second surface opposite the first surface, wherein a first portion of the first surface contacts the first end of one of the two three dimensional structural frame members, wherein a first portion of the second surface contacts the first end of the other three dimensional structural frame member, and wherein a second portion of the first surface and a second portion of the second surface each extend above each second flange of the two three dimensional structural frame members.

12. The enclosure of claim 10, wherein the wall sections each further comprise a bottom wall portion that extends from the wall panel portion.

13. The enclosure of claim 10, further comprising: a roof comprising a plate secured to at least one three dimensional structural frame of the three dimensional structural frames and an overlaying weatherproof membrane, wherein the plate comprises sheet metal, and wherein the overlaying weatherproof membrane is attached to the wall panel portions of the wall sections.

14. A method for lifting the enclosure of claim 10, comprising:

(a) attaching a plurality of lift plates to at least some second ends of the three dimensional structural frames and at least some of the wall panel sections of the opposing walls, wherein a first lift plate of the plurality of lift plates is secured to two or more frames of the three dimensional structural frames, and wherein a second lift plate of the plurality of lift plates is secured to two or more other frames of the three dimensional structural frames, and wherein the first lift plate is secured to two or more wall panel sections of the opposing walls, and the second lift plate is secured to two or more other wall panel sections of the opposing walls;

(b) attaching a harness to the plurality of lift plates; and (c) lifting the enclosure with an upward force to the harness, wherein the first lift plate and the second lift plate each comprises (i) a planar portion comprising a series of a pattern of mounting holes for receiving hardware for securing the plate to the ends of the plurality of frames and the wall panel sections; and (ii) a connecting portion for attaching the harness.

15. The enclosure of claim 10, wherein the variable cross section three dimensional structure is formed from a second single sheet, and wherein the wall sections are each formed from the single sheet.

16. An enclosure, comprising:

(a) a plurality of three dimensional structural frames, wherein at least one three dimensional structural frame of the plurality of three dimensional structural frames comprises:

a frame member comprising an elongated three dimensional structure comprising a first side, a second side, a center support portion, a first flange comprising an inner edge and an outer edge, a web, and a second flange comprising an inner edge and an outer edge, wherein the first side has a variable cross section from a first end to the center support portion, wherein the second side has a variable cross section from a second end to the center support portion, wherein the web extends from the first end to the second end, and wherein the web extends from the inner edge of the first flange to the inner edge of the second flange so as to define a channel, the frame member further comprising mounting flanges at the first end and the second end that at least partially enclose the first end and the second end, wherein the mounting flanges comprise through holes for mounting the frame member, and wherein the elongated three dimensional structure is formed from a single sheet, and transverse stiffeners positioned within the three dimensional structure on the first side and the second side comprising a rigid support structure rigidly fixed to the first flange, the web, and the second flange of the three dimensional structure, wherein the transverse stiffeners are welded to the first flange, the web, and the second flange of the elongated three dimensional structure; and (b) opposing wall portions interconnected by the plurality of three dimensional structural frames, wherein the wall portions comprise a plurality of uniform wall sections, wherein the wall sections each comprise a wall panel portion, a top wall portion that extends from the wall panel portion, and sidewall portions that extend from the wall panel portion, wherein the sidewall portions of the plurality of wall sections are joined to form the wall portions, wherein the wall sections are each formed from a single sheet, wherein the plurality of three dimensional structural frames are attached to the top wall portions of the wall sections, and wherein the at least one three dimensional structural frame of the plurality of three dimensional structural frames is directly attached to the top wall portion of one of the wall sections.

17. The enclosure of claim 16, wherein the at least one three dimensional structural frame of the plurality of three dimensional structural frames further comprises a center support mounted at the center support portion, wherein the center support comprises a connector for a fall protection harness, wherein the connector comprises a first surface and a second surface opposite the first surface, wherein the first surface faces the first end, wherein the second surface faces the second end, such that the first surface and the second surface are each perpendicular to an axis that extends between the first end and the second end, wherein a first portion of the first surface and a first portion of the second surface each contact the second flange, and wherein a second portion of the first surface and a second portion of the second surface each extend above the second flange.

18. The enclosure of claim 16, wherein the wall sections each further comprise a bottom wall portion that extends from the wall panel portion.

19. The enclosure of claim 16, further comprising: a roof comprising a plate secured to at least one three dimensional structural frame of the three dimensional structural frames and an overlaying weatherproof membrane, wherein the plate comprises sheet metal, and wherein the overlaying weatherproof membrane is attached to the wall panel portions of the wall sections.

20. A method for lifting the enclosure of claim 16, comprising:

(a) attaching a plurality of lift plates to at least some second ends of the three dimensional structural frames and at least some of the wall panel sections of the opposing walls, wherein a first lift plate of the plurality of lift plates is secured to two or more frames of the three dimensional structural frames, and wherein a second lift plate of the plurality of lift plates is secured to two or more other frames of the three dimensional structural frames, and wherein the first lift plate is secured to two or more wall panel sections of the opposing walls, and the second lift plate is secured to two or more other wall panel sections of the opposing walls;

(b) attaching a harness to the plurality of lift plates; and (c) lifting the enclosure with an upward force to the harness, wherein the first lift plate and the second lift plate each comprises (i) a planar portion comprising a series of a pattern of mounting holes for receiving hardware for securing the plate to the ends of the plurality of frames and the wall panel sections; and (ii) a connecting portion for attaching the harness.

* * * * *